US008967174B1

(12) United States Patent
Perreault et al.

(10) Patent No.: US 8,967,174 B1
(45) Date of Patent: Mar. 3, 2015

(54) ARTICULATED CONDUIT SYSTEMS AND USES THEREOF FOR FUEL GAS TRANSFER BETWEEN A TUG AND BARGE

(71) Applicant: Moran Towing Corporation, New Canaan, CT (US)

(72) Inventors: Sean Reiley Perreault, Danbury, CT (US); Curtis Leffers, Seattle, WA (US); Matthew William Roddy, Edmonds, WA (US); Matthew Jacob Wichgers, Seattle, WA (US); Jeremy Paul Rice, Seattle, WA (US)

(73) Assignee: Moran Towing Corporation, New Canaan, CT (US)

( * ) Notice: Subject to any disclaimer, the term of this patent is extended or adjusted under 35 U.S.C. 154(b) by 0 days.

(21) Appl. No.: 14/268,874

(22) Filed: May 2, 2014

Related U.S. Application Data

(63) Continuation of application No. 14/242,701, filed on Apr. 1, 2014.

(51) Int. Cl.
*F17D 1/08* (2006.01)
*B63B 21/56* (2006.01)

(52) U.S. Cl.
CPC ..... *B63B 21/56* (2013.01); *B63B 2021/563* (2013.01)
USPC ..... 137/1; 137/615; 141/387; 414/137.9; 414/138.2

(58) Field of Classification Search
USPC ..... 137/615, 1, 15.16; 414/137.9, 138.1, 414/138.2; 141/387
See application file for complete search history.

(56) References Cited

U.S. PATENT DOCUMENTS

| | | | |
|---|---|---|---|
| 2,795,937 | A | 6/1957 | Sattler et al. |
| 3,199,898 | A | 8/1965 | Faccou |
| 3,675,680 | A | 7/1972 | Frohlich et al. |
| 4,022,498 | A | 5/1977 | Jameson |
| 4,388,948 | A | 6/1983 | Carminati et al. |
| 4,393,906 | A | 7/1983 | Gill |
| 4,883,229 | A | 11/1989 | Moeller |
| 6,089,022 | A | 7/2000 | Zednik et al. |
| 6,578,366 | B1 | 6/2003 | Christiansen et al. |
| 6,598,408 | B1 | 7/2003 | Nierenberg |
| 6,644,041 | B1 | 11/2003 | Eyermann |
| 6,688,114 | B2 | 2/2004 | Nierenberg |
| 6,923,225 | B2 | 8/2005 | Poldervaart et al. |

(Continued)

OTHER PUBLICATIONS

[No Author Listed] Design and Construction Specification for Marine Loading Arms. 3rd edition. May 1999.
[No Author Listed] Endura 8000 Series Swivel Manual Dual Split Flange (DSF) Swivel Joint. Oct. 2009.
[No Author Listed] Floating LNG Terminals. The Impact on the Gas Industry. Tanker operator. Jun. 14, 2007.
[No Author Listed] Liquefied Natural Gas. Jun. 1, 2011. Last accessed at http://web.archive.org/web/20110601004217/http://www.cngi.com.au/lng_5.html on May 9, 2014.

(Continued)

*Primary Examiner* — Kevin Lee
(74) *Attorney, Agent, or Firm* — Wolf, Greenfield & Sacks, P.C.

(57) ABSTRACT

According to some aspects, a tug and barge arrangement is provided that is configured with an articulated conduit system for transferring a fuel gas (e.g., natural gas) between the tug and barge. In some embodiments, an articulated conduit system is provided that comprises a plurality of conduits fluidically interconnected by rotatable joints configured to permit positional alterations of the fluid conduits that result from differential movement between a tug and barge, such as relative vertical displacement between the tug and barge and/or relative rotation between the tug and barge about a forward-aft axis of the tug.

30 Claims, 19 Drawing Sheets

(56) References Cited

U.S. PATENT DOCUMENTS

| | | | | |
|---|---|---|---|---|
| 6,938,643 | B2 * | 9/2005 | Pollack | 137/615 |
| 6,997,643 | B2 | 2/2006 | Wille et al. | |
| 7,047,899 | B2 | 5/2006 | Laurilehto et al. | |
| 7,066,219 | B2 | 6/2006 | Poldervaart et al. | |
| 7,080,673 | B2 | 7/2006 | Pollack et al. | |
| 7,147,021 | B2 | 12/2006 | Dupont et al. | |
| 7,174,930 | B2 | 2/2007 | Poldervaart et al. | |
| 7,219,502 | B2 | 5/2007 | Nierenberg | |
| 7,318,319 | B2 | 1/2008 | Hubbard et al. | |
| 7,322,387 | B2 | 1/2008 | Landry et al. | |
| 7,438,012 | B2 | 10/2008 | Kackur | |
| 7,451,604 | B2 | 11/2008 | Yoshida et al. | |
| 7,497,180 | B2 | 3/2009 | Karlsson et al. | |
| 8,186,170 | B2 | 5/2012 | Boatman et al. | |
| 8,375,875 | B2 | 2/2013 | Kim et al. | |
| 8,375,876 | B2 | 2/2013 | Van Tassel | |
| 8,402,983 | B2 | 3/2013 | Harland et al. | |
| 8,499,569 | B2 | 8/2013 | Van Tassel | |
| 8,591,273 | B2 | 11/2013 | Nylund | |
| 2002/0073619 | A1 | 6/2002 | Perkins et al. | |
| 2004/0036275 | A1 | 2/2004 | Pollack | |
| 2004/0154697 | A1 | 8/2004 | Dupont et al. | |
| 2004/0237868 | A1 | 12/2004 | Poldervaart et al. | |
| 2004/0237869 | A1 | 12/2004 | Poldervaart et al. | |
| 2005/0241729 | A1 | 11/2005 | Poldervaart et al. | |
| 2006/0053806 | A1 | 3/2006 | Tassel | |
| 2006/0236699 | A1 | 10/2006 | Klochko et al. | |
| 2007/0214804 | A1 | 9/2007 | Hannan et al. | |
| 2008/0011357 | A1 | 1/2008 | Wille et al. | |
| 2009/0205343 | A1 | 8/2009 | Dupont et al. | |
| 2010/0000252 | A1 | 1/2010 | Morris et al. | |
| 2010/0263389 | A1 | 10/2010 | Bryngelson et al. | |
| 2011/0179810 | A1 | 7/2011 | Sipila et al. | |
| 2011/0277845 | A1 | 11/2011 | Le Devehat et al. | |
| 2011/0302923 | A1 | 12/2011 | Hartono et al. | |
| 2012/0090527 | A1 | 4/2012 | Backlund et al. | |
| 2012/0137955 | A1 | 6/2012 | Van Tassel | |
| 2012/0324910 | A1 * | 12/2012 | Shete et al. | 62/53.2 |
| 2013/0199616 | A1 | 8/2013 | Van Tassel | |
| 2013/0213500 | A1 | 8/2013 | Van Tassel | |
| 2013/0233392 | A1 | 9/2013 | Aarseth | |
| 2014/0053770 | A1 | 2/2014 | Van Tassel | |

OTHER PUBLICATIONS

[No Author Listed] Liquified Natural Gas. Marine Log. Waller Marine Inc. LNG ATB gets ABS Approval in Principle. Oct. 9, 2012. Last accessed at http://wallermarine.com/lng.php on May 9, 2014.

[No Author Listed] Small Scale Distribution of LNG. Argent marine. Last accessed at http://www.argentmarine.com/lngsmall.html on May 9, 2014.

[No Author Listed] Loading Systems. OPW Engineered Systems. 2012.

[No Author Listed] Swivel Joints. OPW Engineered Systems. 2012.

[No Author Listed] Todo® Safety Break-away couplings. Gardner denver product. Downloaded prior to Apr. 1, 2014.

[No Author Listed] Todo-Gas® Couplings. Gardner denver product. Downloaded prior to Apr. 1, 2014.

[No Author Listed] Tugboat and Towboat Types. Tugboat Enthusiasts Society of the Americas. 2007. Last accessed at http://www.tugboatenthusiastsociety.org/pages/tugtypes-notch-tugs-01.htm on May 9, 2014.

[No Author Listed] Waller brings articulated tug barge regas vessels into the picture. Offshore LNG supplement. 2012.

Feger, Gas combustion units: high performance technologies for safe disposal of excess boil off gas on the new generation of LNG carriers. Poster PO-09. 2007.

Gottlieb, Advancements & Challenges. Maersk Argent. LNG Bunkering. HHP Summit Presentation. Sep. 2012.

Hill et al., Offshore power generation using natural gas from remote deepwater developments. Offshore technology conference. 2002. 1-7.

Jansson, A new concept for arctic LNG transportation Wartsila Technical Journal. Jan. 2009. Marine in detail. 42-46.

Karlsson et al., Enabling the safe storage of gas onboard ships with the Wartsila LNGPac. Wartsila Technical Journal. Marine in detail. Jan. 2010. 52-56.

Kim et al., Design and construction of LNG regasification vessel. Gastech. Mar. 2005.

Madsen et al., Regasification modules for onboard applications offer multiple benefits. Wartsila Technical J. 2012. 31-38.

* cited by examiner

ARTICULATED CONDUIT SYSTEMS AND USES THEREOF FOR FUEL GAS TRANSFER BETWEEN A TUG AND BARGE

RELATED APPLICATIONS

This application is a continuation application which claims the benefit under 35 U.S.C. §120 of U.S. application Ser. No. 14/242,701, entitled "ARTICULATED CONDUIT SYSTEMS AND USES THEREOF FOR FLUID TRANSFER BETWEEN TWO VESSELS" filed on Apr. 1, 2014, which is herein incorporated by reference in its entirety.

BACKGROUND

1. Field

Aspects of the disclosure relate to systems and methods for transporting fluids between two vessels, such as a tug and barge.

2. Discussion of Related Art

Tug and barge vessel combinations can be configured to transport gaseous fuels stored as liquid on board the barge. Certain amounts of the stored liquid vaporize to gas, which can be managed in multiple ways. For example, the gas can be i) burned off, ii) re-liquefied and returned to the barge storage tanks, and/or iii) used as fuel for secondary systems on board the barge. In some configurations, vaporized gas can provide an auxiliary fuel source for the tug. Therefore, the tug's main propulsion engines may be capable of being powered by either fuel stored on board the tug, such as diesel fuel, or fuel gas generated through the vaporization of liquid fuel stored on the barge. To provide fuel gas to the tug, systems have been proposed that comprise articulated conduits through which to transfer fuel gas from the barge to the tug. United States Patent Application Publication US 2013/0213500 ("Van Tassel"), published Aug. 22, 2013, discloses a tug and barge arrangement in which natural gas is transferred from the barge to the tug via a gas transfer assembly so that the tug may be powered by the natural gas fuel.

SUMMARY

Aspects of the disclosure are based on a recognition that current systems for transporting fuel gas between a tug to barge are limited by the fact that they fail to adequately account for differential movement between the tug and barge. The inventors have found that the gas transfer assembly in Van Tassel fails to adequately account for differential movement between the tug and barge. In particular, the gas transfer assembly in Van Tassel (as depicted in FIGS. 10 and 11 therein) does not contain the requisite degrees of freedom to allow for normal operation when installed on an articulated tug and barge. In particular, the Van Tassel gas transfer assembly does not allow for the variations in draft, relative difference in heel angle between two vessels (e.g., rotation of a tug about its longitudinal axis relative to a barge), and variations in alignment relative to the pin connection, which are conditions normally experienced in the operation of an articulated tug and barge. Because the system in Van Tassel has insufficient degrees of freedom, normal operation, including through a cycle of pitch motion, for example, would result in failure of the gas transfer assembly. The system is unable to accommodate pitch motion at least in part because it does not allow for simultaneous displacement in the transverse (port-starboard) and vertical directions while allowing for a change in angle at its connection point at the tug or barge.

In contrast, articulated conduit systems provided herein are configured and arranged to transfer fuel gas between a tug and barge (e.g., transfer of fuel gas from tug to a barge, or from a barge to a tug) while adequately accommodating relative motion between the tug and barge. In one illustrative embodiment, an articulated conduit system is provided that includes a plurality of rigid conduits fluidically interconnected by six swivel joints or in some cases at least six swivel joints that are configured with sufficient degrees of freedom to permit positional alterations of the conduits that result from differential movement between a tug and barge. In some embodiments, the articulated conduit systems are useful because they accommodate relative vertical motion that results from changes in relative draft and/or relative pitch motion that occurs between the tug and barge during operation. With regard to vertical motion, the articulated conduit systems accommodate i) vertical displacement of the barge during transfer of cargo and other materials, such as ballast, to and from the barge, which may occur during loading and offloading of LNG, and/or ii) vertical displacement that occurs during transfer of or consumption of fuel, ballast and other materials to and from the tug. With regard to pitch motion, the articulated conduit systems accommodate relative motion as the tug and barge pitch separately during transit on a waterway.

In another illustrative embodiment, a tug and barge arrangement (e.g., an ATB) is provided that is configured with an articulated conduit system disclosed herein for transferring fluid between the tug and the barge, in which the articulated conduit system comprises a plurality of rigid conduits fluidically interconnected by at least six swivel joints that are configured to permit positional alterations of the conduits that result from differential movement between the tug and barge, and in which the system is configured to be secured at a first end on the tug, and at a second end on the barge.

In yet another illustrative embodiment, methods are provided for operating a tug and barge arrangement (e.g., an ATB) that is configured with an articulated conduit system disclosed herein. The methods may involve i) accessing a fuel gas present on a barge; and ii) transferring the fuel gas from the barge to the tug through the articulated conduit system. The tug and barge may or may not be in transit on a waterway while one or more of the steps of the method are carried out. The tug and barge may pitch relative to one another while one or more steps of the method are carried out. For example, the tug and barge may pitch relative to one another within a range of +10 to −10 degrees. The tug and barge may also change drafts relative to one another while one or more steps of the method are being carried out. For example, the relative draft between the tug and barge may change within a range of 1 feet to 5 feet. However, in the context of an ATB having a pin connection engaged between the tug and barge, changes in draft that occur relative to the tug and barge during one or more steps of the method may be negligible due to the nature of the pin connection and its ability to resist differential movement in the vertical direction. In one embodiment, the fuel gas is generated on the barge from a liquid fuel, such as LNG, stored on the barge. The fuel gas transferred to the tug may be used to power a propulsion system of the tug or another system. For example, the fuel gas may serve as fuel for combustion in an engine of the propulsion system, such as a propulsion engine that mechanically operates a propeller of the tug, or an engine coupled to an electric generator that powers an electric propulsion motor of the tug.

In another illustrative embodiment, methods are provided of operating a tug and barge arrangement configured with an articulated conduit system for transferring fluid between the tug and the barge, in which the articulated conduit system comprises a plurality of conduits fluidically interconnected by a plurality of swivel joints that are configured to permit positional alterations of the fluid conduits that result from differential movement between the tug and barge. The methods may involve i) rotating a tug portion of the articulated conduit system from a stowed position on the tug to a first operational position, in which in the first operational position the tug portion has a proximal end on the tug and a distal end extending toward the barge; ii) rotating a barge portion of the articulated conduit system from a stowed position on the barge to a second operational position, in which in the second operational position the barge portion has a proximal end on the barge and a distal end extending toward the tug; iii) fluidically connecting the distal end of the tug portion to the distal end of the barge portion; and iv) after step iii), transferring fuel gas from the barge to the tug through the articulated conduit system. In some embodiments, the articulated conduit system is configured such that, at each rotational position of the tug about its longitudinal axis, up to and including ±1°, ±2°, ±5°, ±10°, or ±20° of rotation relative to the barge, the distal end of the tug portion is connectable in step iii to the distal end of the barge portion. In some embodiments, the articulated conduit system is configured such that, at each relative vertical position of a pin connection of the tug within a vertical channel in a notch of the barge, up to and including 1, 2, 3, 4, 5, 6, 7, 8, 9, 10, 11, 12, 13, 14 or 15 vertical feet from the bottom of the barge, the distal end of the tug portion is connectable in step iii to the distal end of the barge portion.

Other advantages and novel features of the invention will become apparent from the following detailed description of various non-limiting embodiments when considered in conjunction with the accompanying figures and claims.

DETAILED DESCRIPTION

Figure 1A:
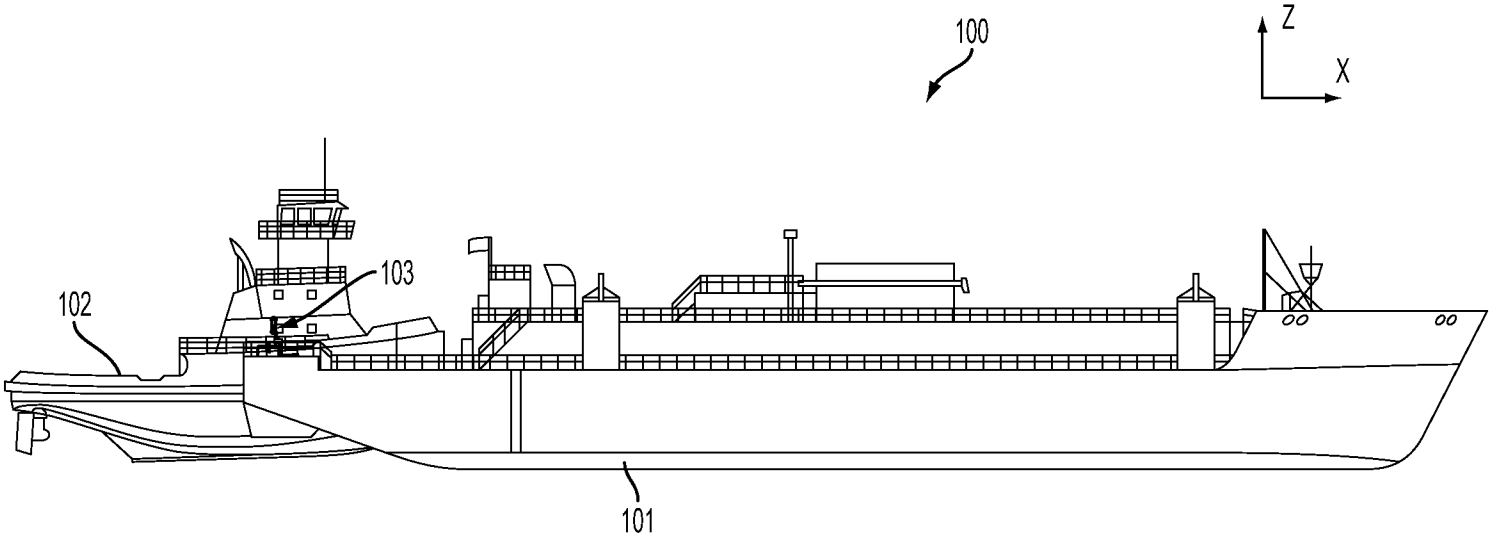
FIG. 1A depicts a non-limiting example of an articulated conduit system configured to transfer gas from a barge to a tug of an articulated tug and barge (ATB), in which the tug is at a 0 degree pitch relative to the barge.

Aspects of the disclosure relate to tug and barge arrangements that utilize fuel gas to supply at least the propulsion system of the tug while coupled to the barge. The fuel gas is supplied to the tug from the barge via an articulated conduit system that comprises a plurality of fluid conduits, such as rigid pipe segments, interconnected by rotatable joints, such as swivel joints. In contrast with current systems proposed for transferring fuel gas between vessels, the articulated conduit systems disclosed herein provide sufficient degrees of freedom that advantageously allow for positional changes, while maintaining a gas-tight seal, to accommodate relative motion between the tug and barge that is experienced during operational conditions. This relative motion includes the draft range of the barge and/or relative pitch motion between the tug and barge. The articulated conduit system accommodates relative vertical displacement of the tug and barge that can occur during a variety of conditions, such as for example, loading and offloading of liquid fuel (e.g., LNG), fluctuations in tug draft due to tug liquid loading and consumption of fuel stored on board the tug, etc. The articulated conduit system also accommodates variations in angle of heel between the tug and the barge, and variations in offset distances from centerline due to variations in pin connections between the tug and barge when the tug and barge are configured as an articulated tug and barge (ATB). The articulated conduit system also accommodates relative rotation between a tug and barge about the longitudinal axis (forward-aft axis). In the context of an ATB, for example, this feature is advantageous because it permits the articulated conduit system to be connected between the tug and barge when the pin connections on the port and starboard sides of the tug are made at different vertical positions within the barge notch. It should be appreciated that the cause of the relative motion may be due to any factor and the present disclosure should not be limited in this regard.

The articulated conduit systems typically include one or more swivel joints (e.g., 1, 2, 3, 4, 5, or more) rotatable about a transverse axis relative to the tug and barge to accommodate pitch motion between the tug and barge. The articulated conduit systems also typically include one or more swivel joints (e.g., 1, 2, 3, 4, 5, or more) rotatable about a vertical axis relative to the tug and barge to accommodate pitch motion between the tug and barge. The articulated conduit systems also may include one or more swivel joints (e.g., 1, 2, 3, 4, 5, or more) rotatable about longitudinal axes relative to the tug and barge, in which the swivel joints are rotatable together to accommodate displacement in the vertical direction relative to the tug and barge. The articulated conduit systems also may include one or more swivel joints (e.g., 1, 2, 3, 4, 5, or more) rotatable about an off-axis (e.g., an axis intersecting (e.g., at 30°, 45°, or 60° angles) transverse and longitudinal axes) relative to the tug and barge, in which the swivel joints are rotatable together to accommodate displacement (e.g., in the vertical direction) relative to the tug and barge. The articulated conduit system may include one or more swivel joints (e.g., 1, 2, 3, 4, 5, or more) swivel joint configurable to permit at least a portion of the conduit system to be rotated between a stowed position and an operational position. It should be appreciated that while the articulated conduit systems may have different configurations with respect to swivel orientation, in any configuration the systems should have at least six to accommodate the various degrees of freedom necessary to accommodate differential movement between the tug and barge.

The articulated conduit systems provided herein may be implemented in a variety of different tug and barge arrangements. In some embodiments, an articulated conduit system provided herein is implemented in an articulated tug and barge (ATB). An ATB is a well-known tug and barge arrangement in which the tug pushes the barge through a pin connection. ATBs may be configured such that the bow region of the tug is positioned within a notch at the stern of the barge, and the tug and barge are connected by two pins each of which extends from a different side (port or starboard) of the tug, along a common transverse axis, into corresponding recesses of the barge notch. The pin connections provide a fixed axis that runs transversely between the tug and barge, and about which the vessels are allowed relative rotation, or pitch motion; other movements such as yaw, roll, and heave are substantially restrained through the pin connection.

Any of a variety of pin connection types may be used, including, for example, any one of an Artubar connection, an Articouple connection, an Intercon connection, an Intercon-C connection, a Bludworth connection, a Hydraconn connection, and a Beacon Jak connection. In some embodiments, a pin connection of the Intercon type is used that comprises a single degree of freedom pin connection within the barge notch, that establishes a transverse, fixed axis between the tug and barge, about which the vessels are allowed free relative rotation, or pitch. In such embodiments, other movements such as yaw, roll, and heave are substantially restrained by the pin connection. Thus, the tug heaves and rolls with the motion of the barge. In some embodiments, the port and starboard sides of the notch wall may be fitted with a vertical channel having confronting open sides that face inward toward the barge centerline. In some embodiments, notches, or teeth may be incorporated on the fore and/or aft sides of the channel to restrain the pins and minimize or eliminate relative vertical motion, e.g., during transit. In some embodiments, the system allows the pin connection to be made at multiple different relative draft positions between the tug and barge by changing the position of the recesses within which the pins are disposed. In such embodiments, the conduits of the articulated conduit systems change position through rotational movement of the joints that interconnect them to accommodate the different relative draft positions.

In some embodiments, articulated conduit systems are provided that can accommodate changes in relative vertical position of up to 1 ft., up to 2 ft., up to 3 ft., up to 4 ft. (e.g., about 3.8 ft.), up to 5 ft., up to 6 ft., up to 7 ft., up to 8 ft., up to 9 ft., up to 10 ft. or more. In some embodiments, articulated conduit systems are provided that can accommodate changes in relative vertical position in a range of 1 ft. to 3 ft., 1 ft. to 5 ft., 1 ft. to 10 ft., 2 ft. to 5 ft., 2 ft. to 10 ft., or 5 ft. to 10 ft.

In some embodiments, articulated conduit systems are provided herein that accommodate relative motion as the tug and barge pitch separately, e.g., during transit on a waterway, such as ocean-going transit. The articulated conduit system may be configured to accommodate the full span of pitch rotation that occurs between a tug and barge in an ATB arrangement. In this regard, in some embodiments, articulated conduit systems are provided that can accommodate changes in relative pitch in a range of −1° to +1°, −5° to +5°, −10° to +10°, −20° to +20°, or −30° to +30°. In some embodiments, articulated conduit systems are provided that can accommodate changes in relative pitch of up to ±1°, up to ±2°, up to ±3°, up to ±4°, up to ±5°, up to ±10°, up to ±20°, up to ±30°, or more.

Articulated conduit systems are also provided that accommodate relative rotation between a tug and barge about a longitudinal axis (forward-aft axis). In this regard, articulated conduit systems are provided that can accommodate relative rotation between a tug and barge about a longitudinal axis in a range of −1° to +1°, −5° to +5°, −10° to +10°, −20° to +20° or more. In some embodiments, articulated conduit systems are provided that can accommodate relative rotation between a tug and barge about a longitudinal axis of up to ±1°, up to ±2°, up to ±3°, up to ±4°, up to ±5°, up to ±10°, up to ±20° or more. In the context of an ATB, the articulated conduit system may be configured for transferring fuel gas between the tug and barge when pin connections on the port and starboard sides of the tug are made at different vertical positions within the barge notch. The difference in vertical position may be up to 1 ft., up to 2 ft., up to 3 ft., up to 4 ft., up to 5 ft., or more. The difference in vertical position may be 1 ft. to 2 ft., 1 ft. to 3 ft., 1 ft. to 5 ft., or 1 ft. to 10 ft.

According to some aspects of the disclosure, the articulated conduit systems provided herein comprise a plurality of fluid conduits (e.g., pipe segments, elbow joints, flange joints, flexible hose, dry break couplings, breakaway couplings) interconnected by swivel joints that allow the plurality conduits to change position to accommodate relative motion between the tug and barge.

The swivel joints facilitate sufficient degrees of freedom in the articulated conduit system to adapt to the relative motions of the vessels and to aide in alignment for making a connection between the tug and barge (e.g., a dry break coupling connection). The swivel joints typically allow for rotation (e.g., 360 degrees) in a plane substantially perpendicular to the longitudinal conduit axis.

The swivel joints are generally configured to rotate (e.g., 360 degrees) while maintaining a gas-tight seal. In some embodiments, the articulated conduit systems are configured to enable gas transfer through the system at pressures at or below 2 atm, at or below 3 atm, at or below 4 atm, at or below 5 atm, at or below 6 atm, at or below 7 atm, at or below 8 atm, at or below 9 atm, or at or below 10 atm while maintaining a gas tight seal. In some embodiments, the articulated conduit systems are configured to enable gas transfer through the system at pressures 1 atm to 2 atm, 1 atm to 4 atm, 2 atm to 4 atm, 2 atm to 8 atm, or 3 atm to 10 atm while maintaining a gas tight seal. In some embodiments, the operating pressure of an articulated conduit system is determined by the operating pressure of its swivel joints.

Swivel joints may be configured to allow seal replacement without disassembly of the joint. The swivel joints may include redundant sealing. The swivel joints may have a main seal and a back-up seal. In such cases, if the main seal leaks (e.g., due to normal wear), the back-up seal is configured to contain the fluid. A third seal (e.g., an environmental seal) may also be included in the joint to provide a third layer of protection against leakage.

In some cases, when operating at low minimum ambient temperatures (e.g., during operation at or below 4° C.) it may be advantageous to use a low temperature seal material, such as, e.g., Buna-N 1500, fluorocarbon, polytetrafluoroethylene (PTFE), perfluoroalkoxy (PFA), PTFE (or PFA) encapsulated silicone, ethylene propylene (EPDM) rubber, Kalrez® or another suitable low temperature material. However, it should be appreciated that the articulated conduit systems may be configured to transfer gas at a temperature in a range of up to 20° C., up to 30° C., up to 40° C., up to 50° C., or up to 60° C. In some embodiments, the articulated conduit systems are configured to transfer gas at a temperature in a range of −20° C. to 60° C., −20° C. to 20° C., −20° C. to 0° C., 0° C. to 20° C., 0° C. to 30° C., 0° C. to 60° C., 10° C. to 30° C., 10° C. to 40° C., 20° C. to 40° C., 20° C. to 50° C., 30° C. to 50° C. or 30° C. to 60° C.

The swivel joints may be configured with one or more removable plate assemblies (e.g., flange plate assemblies) that provide access to seals and facilitate seal repair and/or replacement. In some embodiments, seal leakage (e.g., main seal leakage) is channeled to an access port provided in the joint. The access port may serve as a leak detection port that is configured to permit monitoring of gas leakage. An inert gas may be injected in the access port and maintained in a cavity of the swivel joint adjacent to it seals. The inert gas can be provided at a higher pressure than the contained fuel gas pressure to aide in containing the fuel gas within the conduit system, and minimize the likelihood of fuel gas emissions through the access port. In some embodiments, swivel joint seals have groove surfaces (e.g., produced by a micro finish machine process) that minimizes seal wear.

In some embodiments, swivel joints comprise inner and outer seals configured such that a chamber is formed between the inner and outer seals. This chamber may be filled or charged with an inert gas, which may be present in the chamber at a pressure greater than the fuel gas system pressure. The chamber may also be instrumented with a pressure gauge to facilitate monitoring of seal integrity. For example, the joint may be configured such that if the outer seal fails, the inert gas escapes the chamber to atmosphere. The joint may also be configured such that the inert gas is present in the chamber at a higher pressure than the fuel gas system, whereby, if the inner seal fails, the inert gas will leak into the fuel gas pipeline. The joint may be configured such that leakage of insert gas out of the chamber due to inner and/or outer seal failure produces an alarm that alerts an operator of the leak. In some cases, the fuel gas system may be secured (e.g., automatically secured) in response to a leakage. Accordingly, in some embodiments, presence of the inert gas in the chamber facilitates monitoring of seal integrity and/or control of the fuel gas system.

The swivel joints may be configured with bearings to facilitate rotation and reduce wear (e.g., to enable extended use under ongoing or constant motion). Swivel joint bearings may be configured with hardened steel bearing races. Use of such joint bearing can minimize wear and fatigue on the swivels, and provide improved service life. A swivel joint bearing may have a single or double race design. In some embodiments, swivel joints comprise replaceable bearings (e.g., snap-in ball bearing races).

It should be appreciated that any swivel type joint may be employed, as the present disclosure is not limited in this regard. Suitable swivel joints include those of the Endura™ DSF swivel joint type. Endura™ DSF swivel joints are supplied by OPW Engineered Systems in Lebanon, Ohio. In some embodiments, (e.g., for an articulated conduit systems on an ATB) a steel (e.g., stainless steel) swivel body may be used.

Figure 1B:
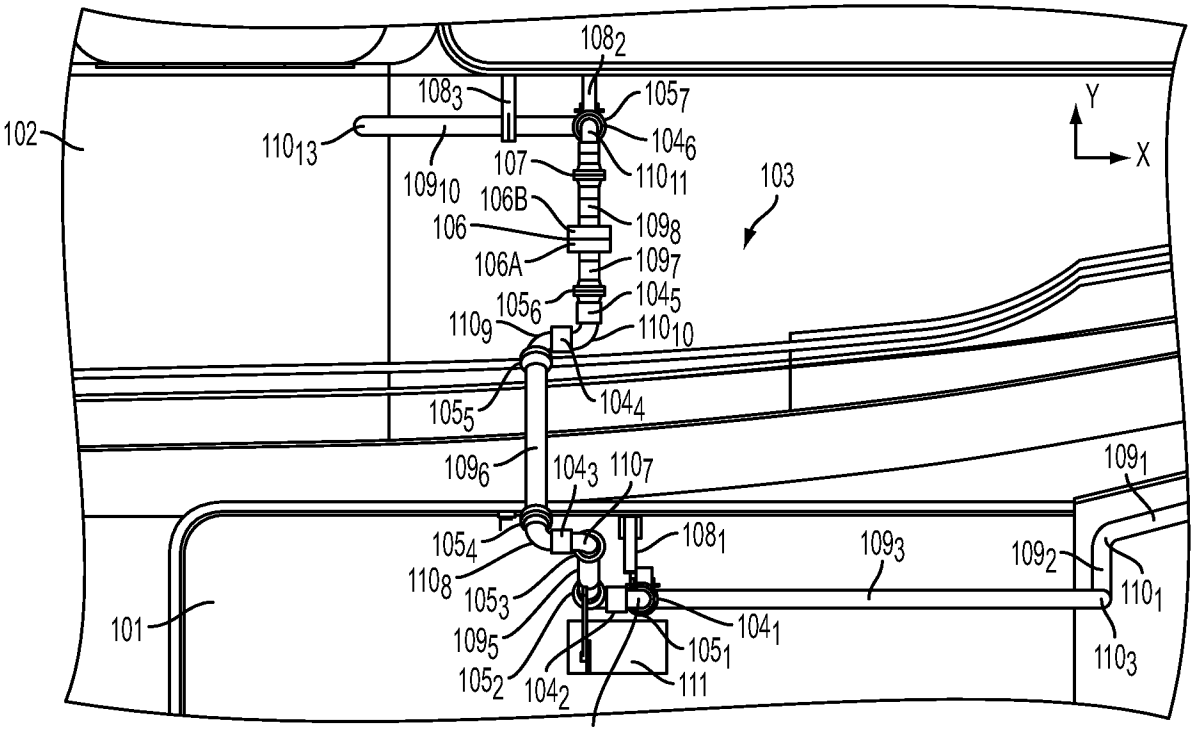
FIG. 1B shows a top view of the articulated conduit system of FIG. 1A.
Figure 1C:
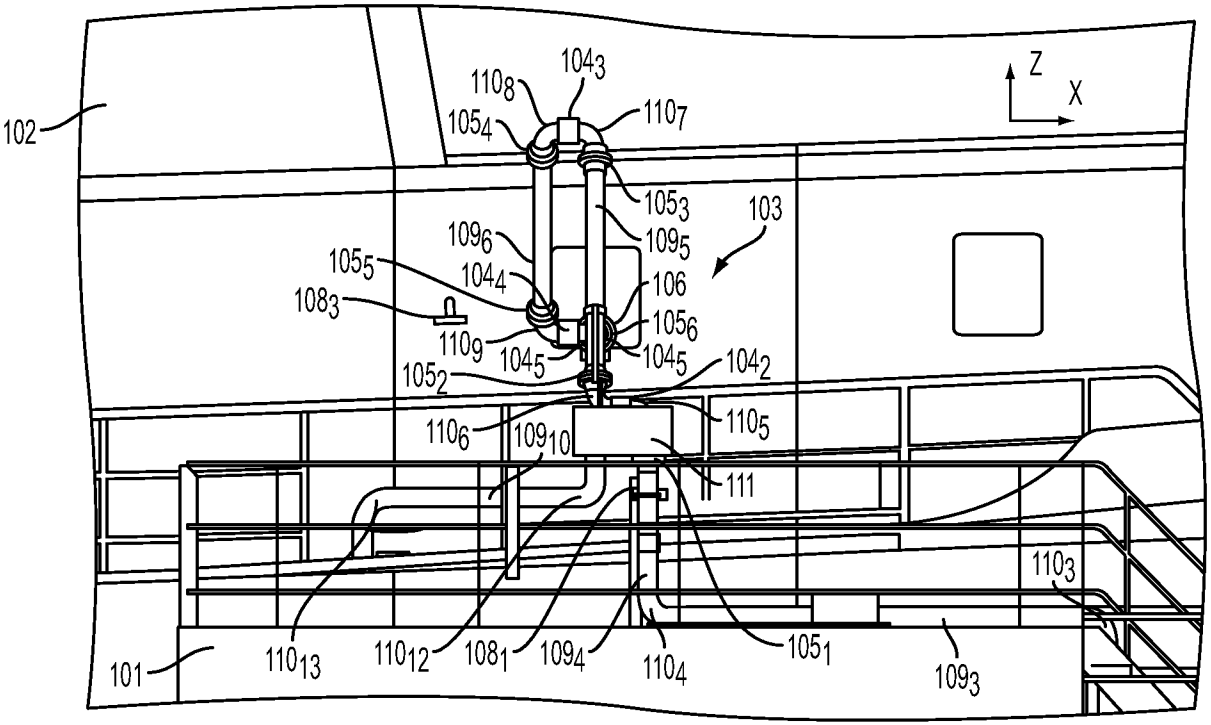
FIG. 1C shows a side view of the articulated conduit system of FIG. 1A, facing the starboard side of the tug.
Figure 1D:
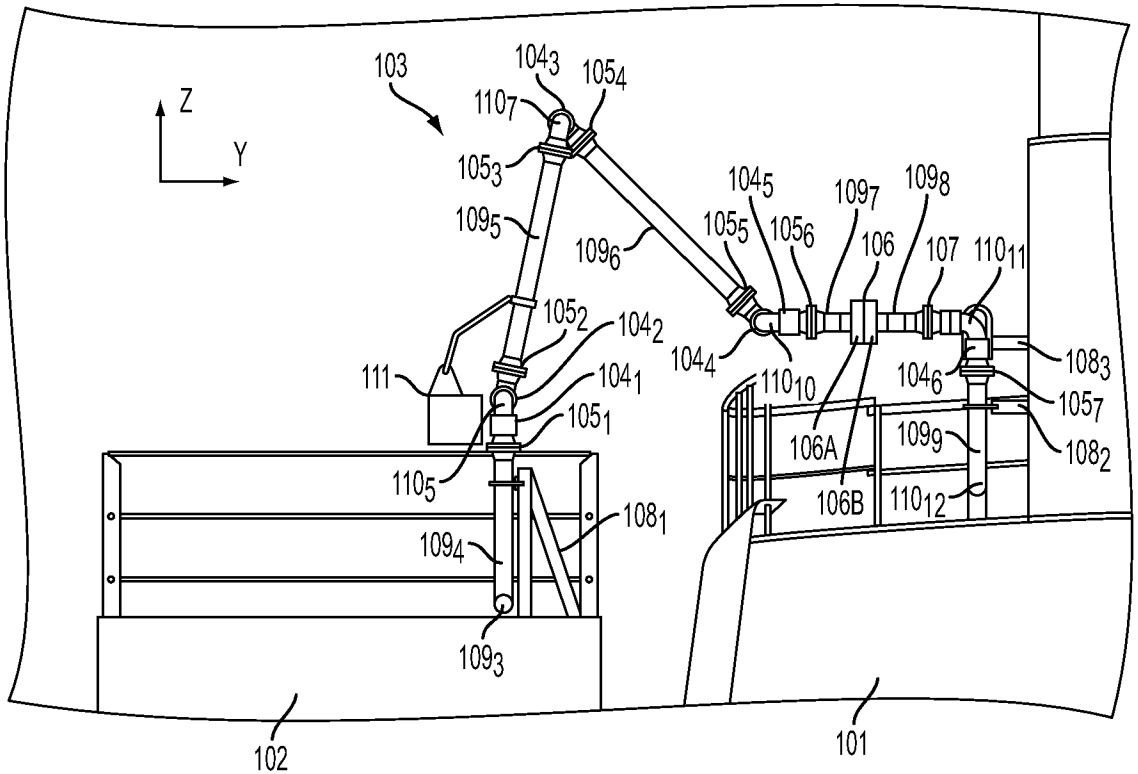
FIG. 1D shows a side view of the articulated conduit system of FIG. 1A, facing aft.
Figure 1E:
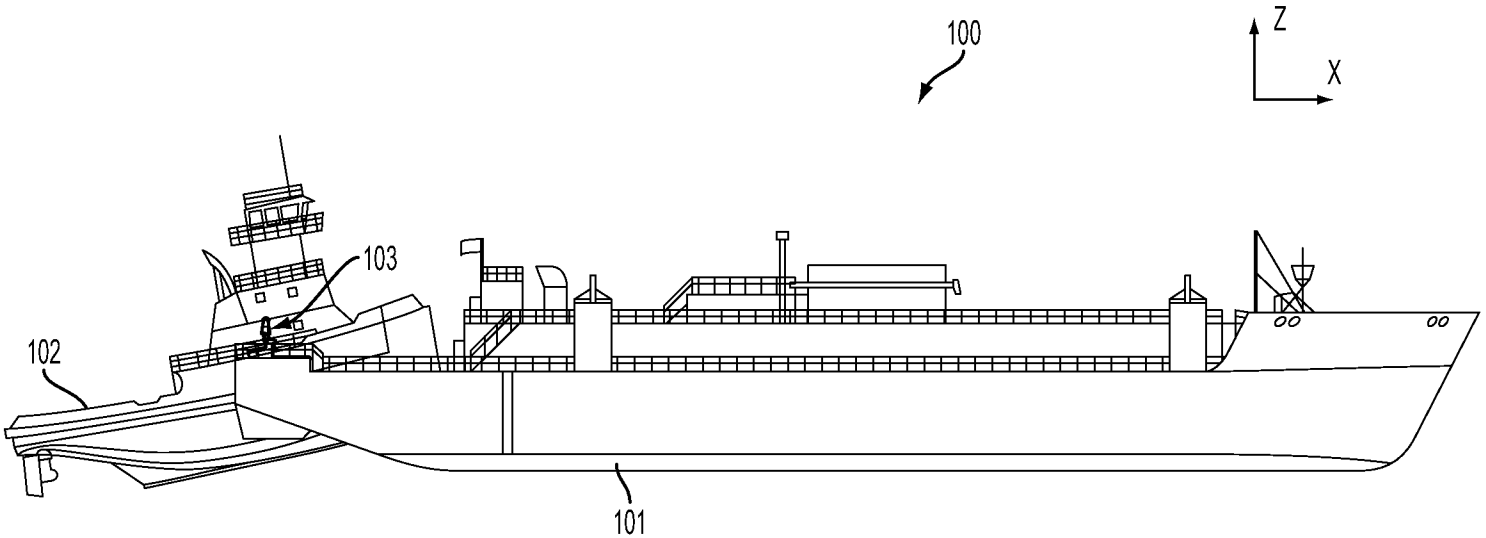
FIG. 1E depicts the articulated conduit system of FIG. 1A, in which the tug is at a +10 degree pitch relative to the barge.
Figure 1F:
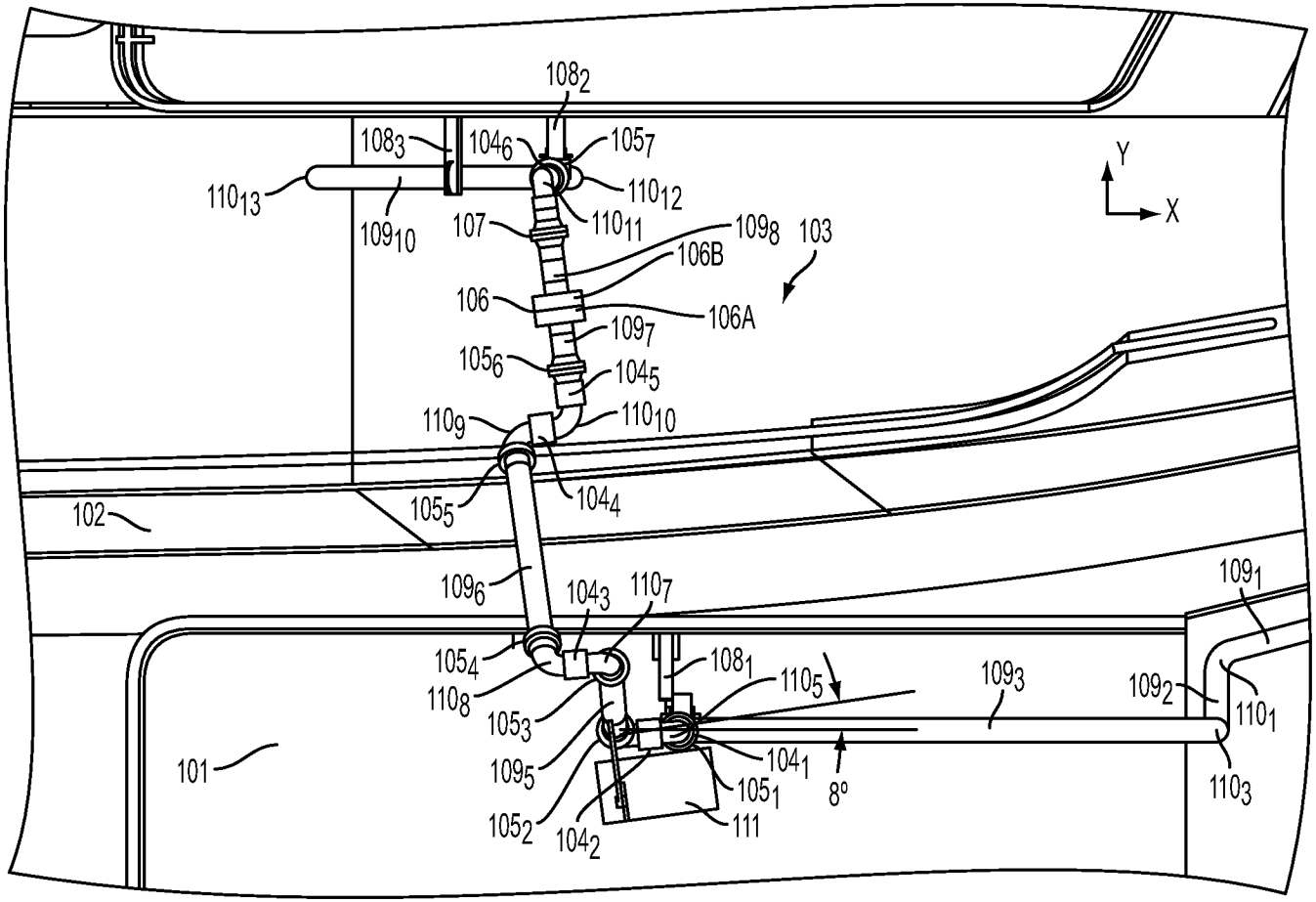
FIG. 1F shows a top view of the articulated conduit system of FIG. 1E.
Figure 1G:
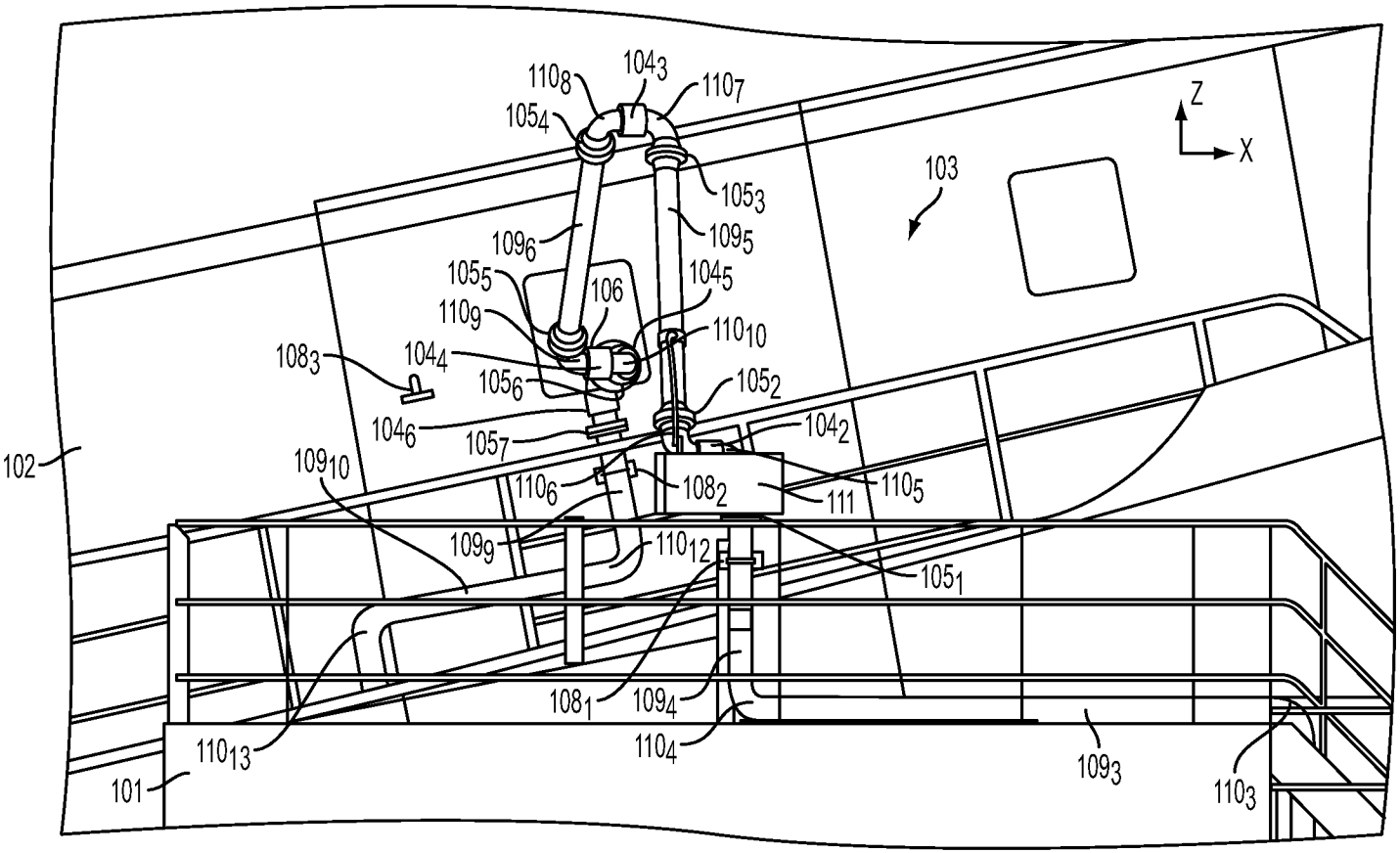
FIG. 1G shows a side view of the articulated conduit system of FIG. 1E, facing the starboard side of the tug.
Figure 1H:
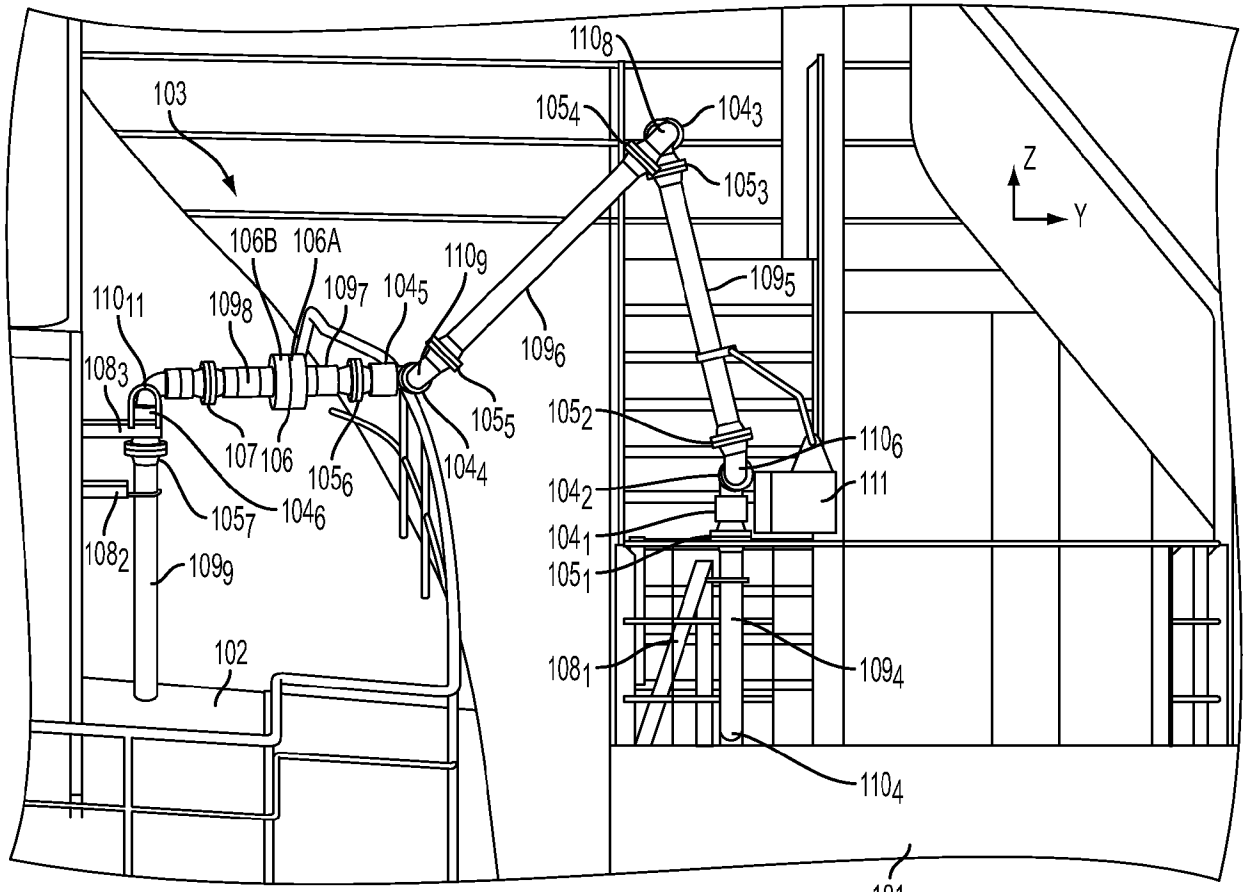
FIG. 1H shows a side view of the articulated conduit system of FIG. 1E, facing forward.
Figure 1I:
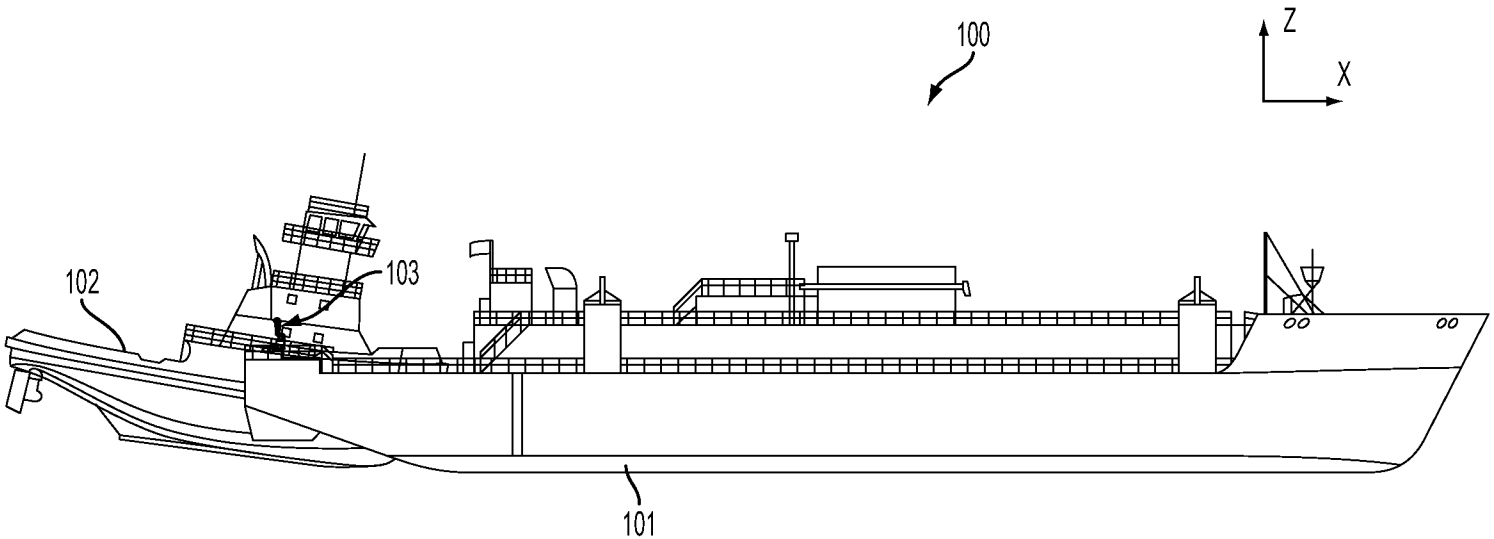
FIG. 1I depicts the articulated conduit system of FIG. 1A, in which the tug is at a −10 degree pitch relative to the barge.
Figure 1J:
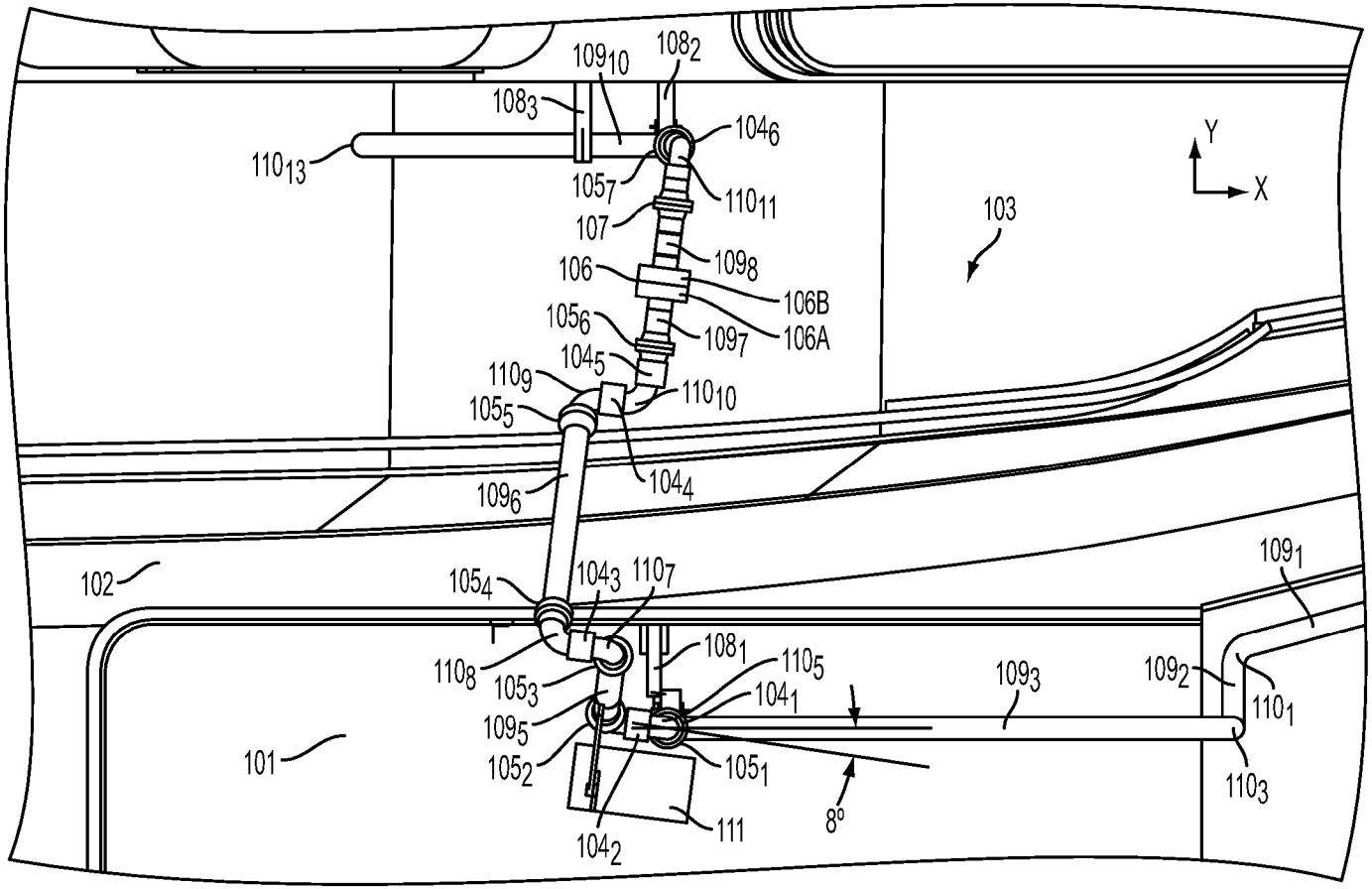
FIG. 1J shows a top view of the articulated conduit system of FIG. 1I.
Figure 1K:
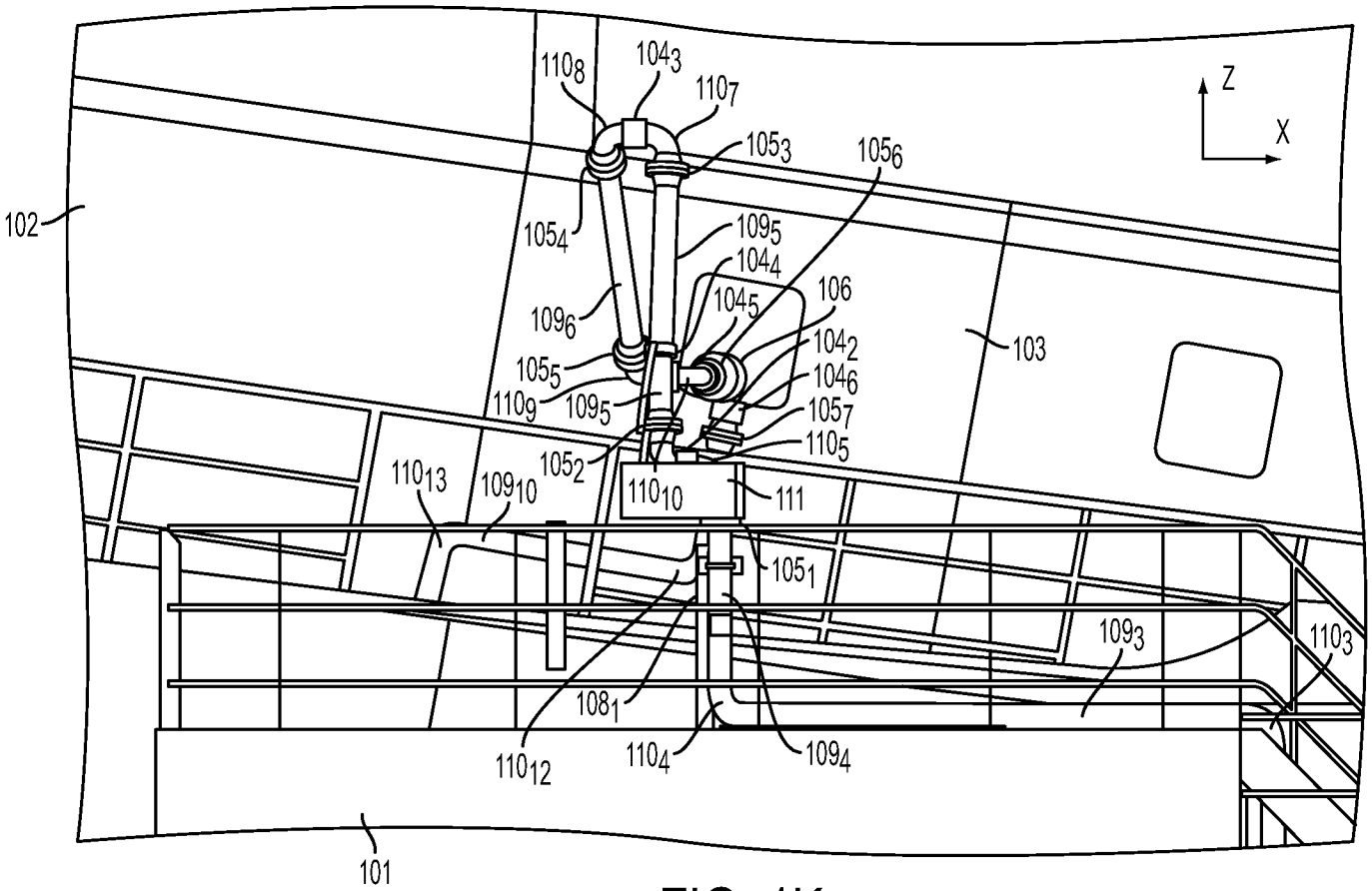
FIG. 1K shows a side view of the articulated conduit system of FIG. 1I, facing the starboard side of the tug.
Figure 1L:
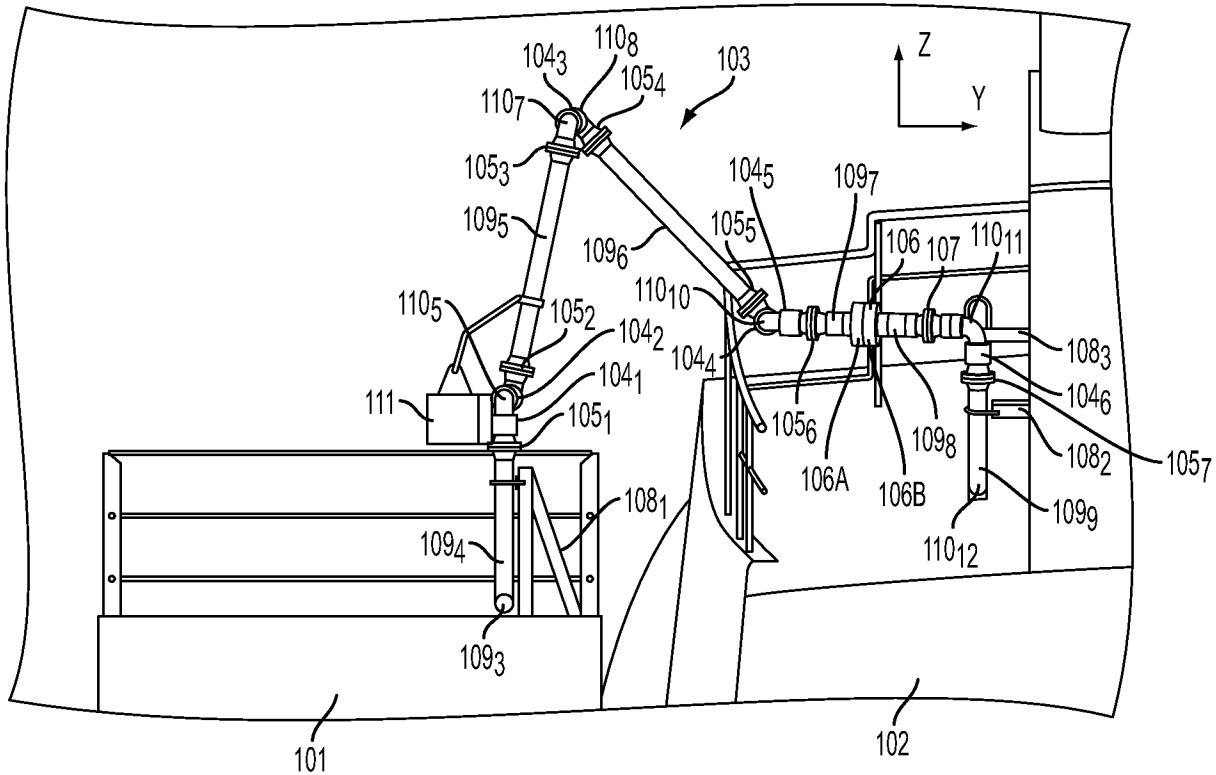
FIG. 1L shows a side view of the articulated conduit system of FIG. 1I, facing aft.
Figure 1M:
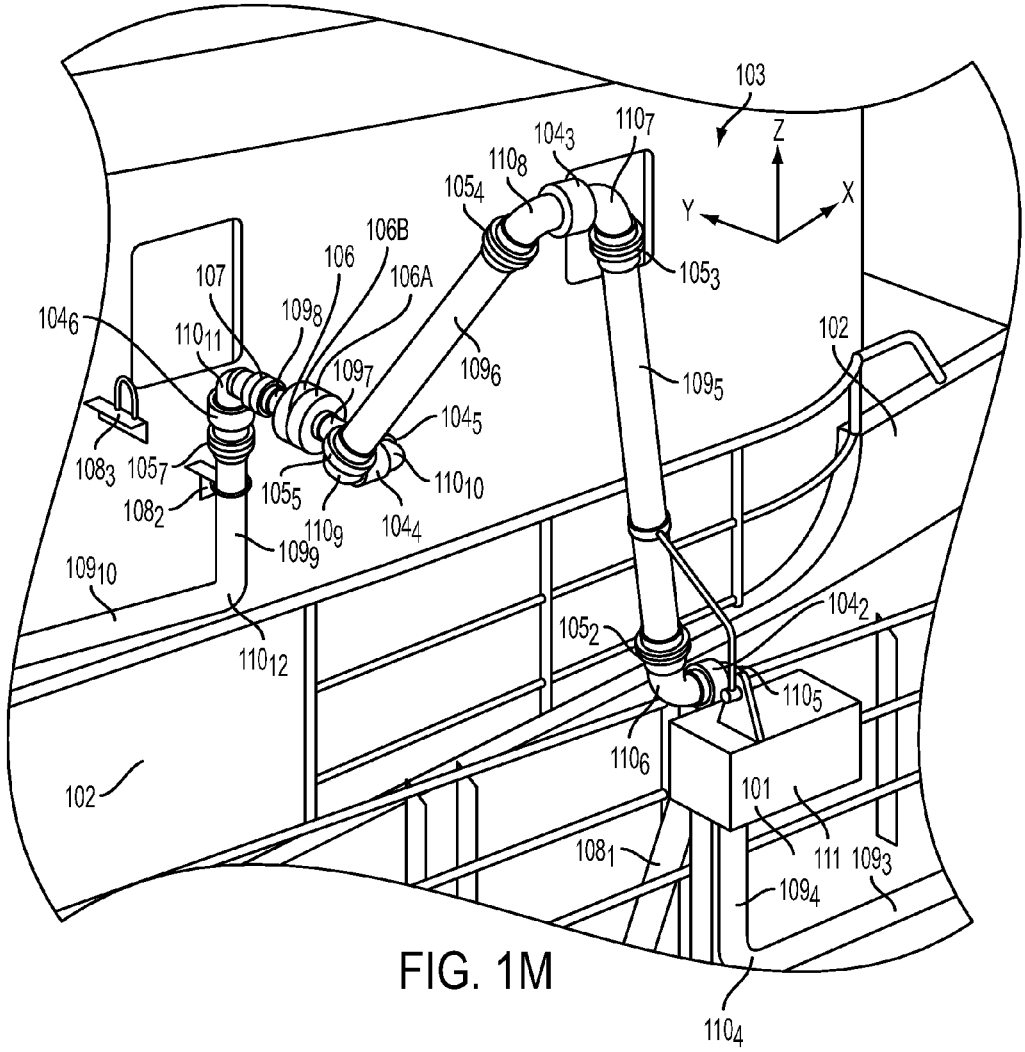
FIG. 1M depicts a perspective view of the articulated conduit system of FIG. 1A in an operational position.
Figure 1N:
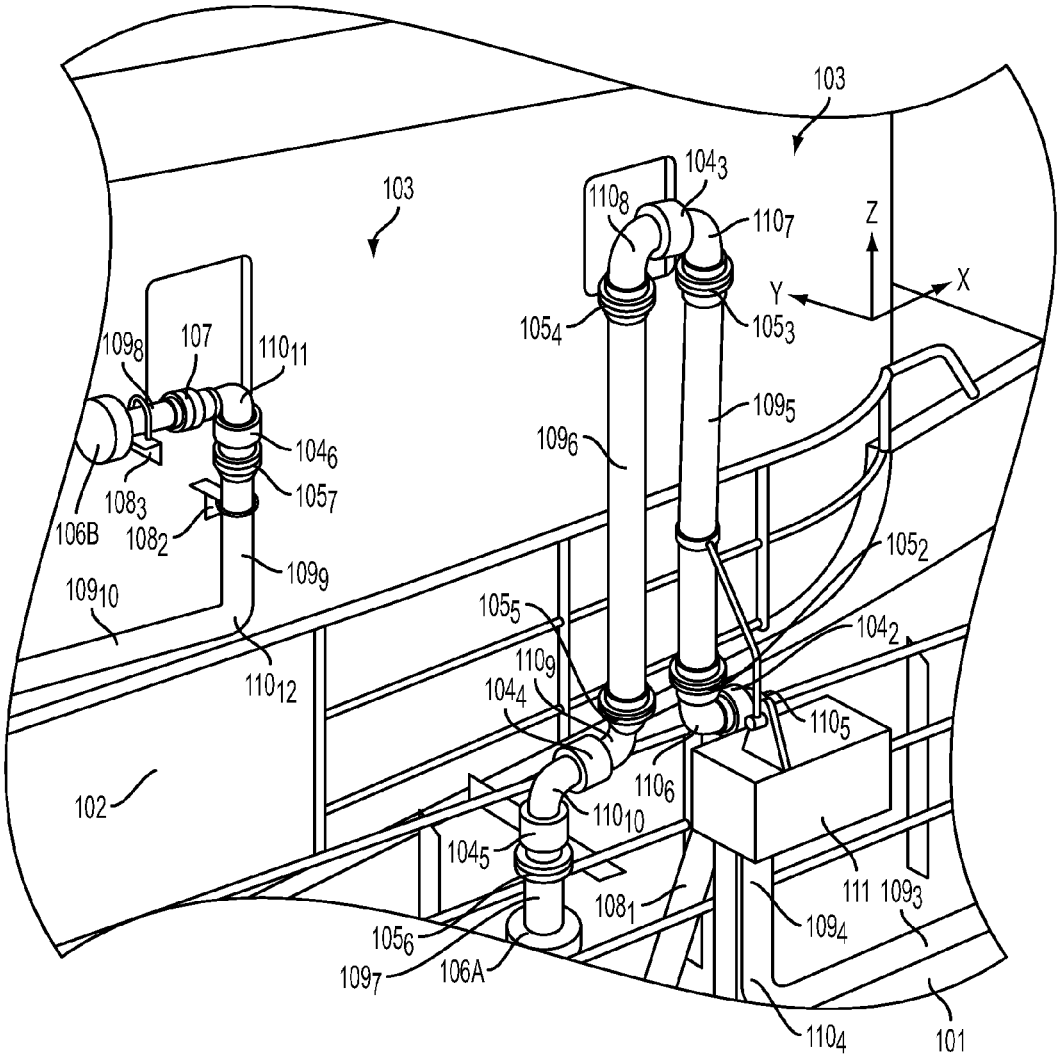
FIG. 1N depicts a perspective view of the articulated conduit system of FIG. 1A in a stowed position.

With reference to FIGS. 1A-1N, a non-limiting example is provided of an articulated tug and barge (ATB) 100 having an articulated conduit system 103 that enables the transfer of fuel gas (e.g., LNG) from a barge 101 to a tug 102 to supply fuel to at least the main engines (e.g., main engine-generators) of the tug 102. FIGS. 1A-M shows the articulated conduit system 103 in an operational position in which the system is fluidically connected between the barge 101 and the tug 102, providing a gas tight conduit through which fuel gas may be transferred from the barge 101 to the tug 102. FIG. 1N shows the articulated conduit system 103 in a stowed position. Coordinate systems are provided to facilitate description of the spatial arrangement of components parts. The articulated conduit system 103 include six swivel joints $\mathbf{104}_{1\text{-}6}$ that are configured to accommodate differential movement between the barge 101 and the tug 102, including vertical displacement and pitch motion.

FIGS. 1A-1D show the articulated conduit system 103 with the tug 102 at a 0 degree pitch relative to the barge 101. The articulated conduit system includes a series of conduits, including rigid pipe segments $\mathbf{109}_{1\text{-}10}$ and elbow joints $\mathbf{110}_{1\text{-}13}$, interconnected by the swivel joints $\mathbf{104}_{1\text{-}6}$. Rigid pipe segments $\mathbf{109}_{1\text{-}4}$ are connected in series through elbows $\mathbf{110}_{1\text{-}4}$, respectively. Rigid pipe section $\mathbf{109}_4$, which is orientated vertically (along the Z-axis) in FIG. 1B, is connected at its a lower end to elbow $\mathbf{110}_4$ and at its upper end to flange joint $\mathbf{105}_1$. Flange joint $\mathbf{105}_1$ is connected to swivel joint $\mathbf{104}_1$, which in turn is connected to elbow joint $\mathbf{110}_5$.

Swivel joint $\mathbf{104}_1$ is oriented in the Z direction and is rotatable about the Z-axis allowing for displacement of the articulated conduit system 103 in the X and Y directions. Swivel joint $\mathbf{104}_1$ allows the articulated conduit system 103 that extends from swivel joint $\mathbf{104}_1$ to be rotated into the operational position, which is the position depicted in FIGS. 1A-1M, and back to the stowed position, which is the position depicted in FIG. 1N. Thus, swivel joint $\mathbf{104}_1$ resolves relative motion by allowing for displacement in the X direction. In this configuration, relative motion between the tug and the barge in the Y direction is minimal because it is restrained by the ATB pin system.

Elbow joint $\mathbf{110}_5$ is connected on its opposite side to swivel joint $\mathbf{104}_2$, which in turn is connected to elbow joint $\mathbf{110}_6$. Swivel joint $\mathbf{104}_2$ is oriented in the X direction and rotates about the X-axis allowing for displacement in the Y and Z directions. Displacement in the Z direction allows the arm to handle the relative motion between the vessels in the Z direction while the tug pitches. Swivel joint $\mathbf{104}_2$ is configured to be rotatable in concert with swivel joints $\mathbf{104}_3$ and $\mathbf{104}_4$ to enable the scissor like displacement. Elbow joint $\mathbf{110}_6$ is connected to flange joint $\mathbf{105}_2$, which in turn is connected to rigid pipe section $\mathbf{109}_5$. When in the operational position, rigid pipe section $\mathbf{109}_5$ extends upwardly at an angle toward tug 102 and is connected at its upper end to flange joint $\mathbf{105}_3$. Flange joint $\mathbf{105}_3$ is connected to elbow joint $\mathbf{110}_7$, which in turn is connected to swivel joint $\mathbf{104}_3$. Swivel joint $\mathbf{104}_3$ is oriented in the X direction and rotates about the X-axis allowing for displacement in the Y and Z directions. Displacement in the Z direction allows the arm to accommodate the relative motion between the vessels in the Z direction while the tug pitches.

Swivel joint $\mathbf{104}_3$ is connected to elbow joint $\mathbf{110}_8$, which in turn is connected to flange joint $\mathbf{105}_4$. Flange joint $\mathbf{105}_4$ is connected at its opposite end to rigid pipe section $\mathbf{109}_6$, which extends downwardly toward the tug (when in the operational position). Rigid pipe section $\mathbf{109}_6$ is connected on its opposite side to flange joint $\mathbf{105}_5$, which in turn is connected to elbow joint $\mathbf{110}_9$.

Elbow joint $\mathbf{110}_9$ is connected to swivel joint $\mathbf{104}_4$, which in turn is connected to elbow joint $\mathbf{110}_{10}$. Swivel joint $\mathbf{104}_4$ is oriented in the X direction and rotates about the X-axis allowing for displacement in the Y and Z directions. Swivel joint $\mathbf{104}_4$ is configured to be rotatable in concert with swivel joints $\mathbf{104}_2$ and $\mathbf{104}_3$ to enable scissor like displacement, allowing the loading arm to articulate in the Y and Z directions. This configuration also accommodates changes in draft between the tug 102 and barge 101 by allowing the arm to displace in the Z direction. Displacement in the Z direction also allows the arm to accommodate the relative motion between the vessels in the Z direction while the tug pitches relative to the barge.

In some cases, swivel joints $\mathbf{104}_2$, $\mathbf{104}_3$, and $\mathbf{104}_4$ permit relative rotation about a longitudinal axis between the tug and barge. For example, swivel joints $\mathbf{104}_2$, $\mathbf{104}_3$, and $\mathbf{104}_4$ may accommodate differences in relative position about a longitudinal axis that are occur when the tug pin connections are positioned and/or locked in different sockets within a barge notch. For example, a port pin connection may be positioned and/or locked in a socket (vertical channel) within the barge notch that is 10 ft. from the bottom of the barge, and a corresponding starboard connection may be similarly positioned and/or locked in 11 ft. from the bottom of the barge.

Elbow joint $\mathbf{110}_{10}$ is connected to swivel joint $\mathbf{104}_5$, which in turn is connected to flange joint $\mathbf{105}_6$. Swivel $\mathbf{104}_5$ is oriented in the Y direction and rotates about the Y-axis allowing for displacement in the X and Z directions. Swivel $\mathbf{104}_5$ handles the pitch motion between the tug and barge.

Elbow joint $\mathbf{110}_{11}$ is connected to swivel joint $\mathbf{104}_6$. Swivel joint $\mathbf{104}_6$ is oriented in the Z direction and rotates about the Z-axis allowing for displacement in the X and Y directions. Swivel $\mathbf{104}_6$ allows the connection arm on the tug side to be rotated into the operational position and back to a stowed position. Swivel $\mathbf{104}_6$ also resolves relative motion between the tug 102 and barge 101 by allowing for displacement in the X direction. In this configuration, relative motion between the tug 102 and the barge 101 in the Y direction may be negligible because it is restrained by the ATB pin system.

FIG. 1E shows the positioning of articulated conduit system 103 in the context of the ATB 100 when tug 102 is at a +10 degree pitch relative to barge 101. FIG. 1F shows a top view of articulated conduit system 103 of FIG. 1E. FIG. 1G shows a side view of articulated conduit system 103 of FIG. 1E facing the starboard side of tug 102. FIG. 1H shows a side view of articulated conduit system 103 of FIG. 1E facing forward. Differences in the relative positioning of the components that are accommodated through rotation of the swivel joints $\mathbf{104}_{1\text{-}6}$ resulting from the 10 degrees relative pitch motion between the tug 101 and barge 102 are evident by comparing FIGS. 1A-D with FIGS. 1E-H. For example, as denoted in FIG. 1F, swivel joint $\mathbf{104}_1$ is rotated about 8 degrees counterclockwise compared with its position at 0 degrees of pitch.

FIG. 1I shows the positioning of articulated conduit system 103 in the context of the ATB 100 when the tug 102 is at a −10 degree pitch relative to the barge 101. FIG. 1J shows a top view of articulated conduit system 103 of FIG. 1I. FIG. 1K shows a side view of articulated conduit system 103 of FIG. 1I facing the starboard side of tug 102. FIG. 1L shows a side view of articulated conduit system 103 of FIG. 1I facing aft. Differences in the relative positioning of the components that are accommodated through rotation of the swivel joints $\mathbf{104}_{1\text{-}6}$ resulting from the 10 degrees relative pitch motion between the tug 101 and barge 102 are evident by comparing FIGS. 1A-D with FIGS. 1I-L. For example, as denoted in FIG. 1J, swivel joint $\mathbf{104}_1$ is rotated by about 8 degrees clockwise compared with its position at 0 degrees of pitch.

The articulated conduit system 103 may optionally include a dry break coupling 106, which may serve as a connection for joining the portion of an articulated conduit system 103 on the barge 101 with the portion on the tug 102. The dry break coupling 106 may serve as a primary fuel gas coupling. Flange joint $\mathbf{105}_6$ may be connected to rigid pipe section $\mathbf{109}_7$, which may in turn be connected to the barge half of a dry break coupling 106A. The tug half of the dry break coupling 106B may be connected to rigid pipe section $\mathbf{109}_8$, which in turn may be connected to a breakaway coupling 107. In such a configuration, swivel joint $\mathbf{104}_2$ allows the loading arm (e.g., the portion of the articulated conduit system 103 that extends from swivel joint $\mathbf{104}_1$ to the barge half of dry break coupling 106A) to articulate in the Y direction to connect the dry break coupling 106. Swivel joints $\mathbf{104}_{2\text{-}4}$ may be configured to be rotatable in concert to create a scissor like displacement that facilitates alignment of the barge half of the dry break coupling 106A and the tug half of the dry break coupling 106B for purposes of connecting the dry break coupling 106 for the transfer of fuel gas from the barge to the tug.

The dry break coupling 106 may be a quick disconnect style fitting that is designed to automatically seal off both sides of the connection upon opening. Use of a quick disconnect style fitting may greatly minimize release of any gases and prevent contamination of the articulated conduit system 103. This self-sealing property of the dry break coupling 106 may be mechanically achieved through cams and/or springs, for example. The dry break coupling 106 may optionally comprise an integrated pressure relief valve that allows the connection to be made while the system is pressurized (e.g., with an inert gas). It should be appreciated that any suitable dry break coupling 106 may be employed, as the present disclosure is not limited in this regard. Suitable examples of dry break couplings are supplied by TODO AB, Toreboda, Sweden (e.g., TODO-MATIC® line) and Cargo Transfer Systems B.V. (CTS), Rotterdam, Netherlands (e.g., CTC Coupling line).

A breakaway coupling 107 may optionally be provided. For example, the breakaway coupling 107 may be connected to elbow $\mathbf{110}_{11}$, which in turn is connected to swivel joint $\mathbf{104}_6$. The breakaway coupling 107 may serve as an emergency disconnect that breaks the articulated conduit system 103, sealing off both sides, in the event that the tug unexpectedly pulls out of the ATB notch. Thus, the breakaway coupling 107 may protect the articulated conduit system 103 in the event of an emergency tug departure from a barge notch, in which there is insufficient time for a normal gas system shut down and decoupling. The breakaway coupling 107 may be used in conjunction (e.g., arranged in series) with a dry break coupling 106 for use in an emergency situation. The breakaway coupling 107 may be designed to be overhauled relatively easily following activation. The breakaway coupling 107 may be configured such that it can be immediately recoupled after an emergency disconnect. The breakaway coupling 107 may employ a mechanical fuse to provide its breakaway function, and the mechanical fuse may be replaceable without disassembly of the coupling. The breakaway coupling 107 may have an automatic double valve arrangement to seal both of its ends in the event of a breakaway. It should be appreciated that any suitable breakaway coupling 107 may be employed, as the present disclosure is not limited in this regard. Suitable examples are supplied by TODO AB in Toreboda, Sweden (e.g., TODO® Safety Break-Away Couplings).

In some cases, an integrated dry break and breakaway coupling may be used, e.g., rather than separate dry break and breakaway couplings (suitable examples are supplied by Dixon Valve and Coupling in Chestertown, Md.)

Loads on the fuel connection at the tug side of a dry break coupling 106 and/or breakaway coupling 107 may be controlled to minimize the likelihood of system failure. For example, the break force of the breakaway coupling 107 may be controlled to ensure that the articulated conduit system 103 does not fail at the coupling under normal operational conditions, but does break under detrimental scenarios, e.g., unexpected pull out of the tug from the barge notch. For example, the installation angles of the components (e.g., pipe segments) of the articulated conduit system 103 may be designed to control loads on the fuel connection at that dry break coupling 106 and/or breakaway coupling 107. The articulated conduit system 103 may also be configured to accommodate dynamic forces resulting from relative pitch accelerations of the tug 102 and barge 103 as well as static loads due to structure weight.

The weight of articulating sections of the articulated conduit system 103 may be minimized or controlled to facilitate coupling or de-coupling by a single crew member. For example, some configurations a spring support device may be provided to off-set the weight of the extended conduit system. The articulated conduit system 103 comprise a counterbalance device 111 that may be configured to support or offset the weight of the extended conduit system and provide a small amount of restoring force (e.g., 10-15 lbs.) that allows the arm to be maneuvered manually by a single operator. The counterbalance device 111 may also minimize load applied to the fixed piping manifold or connection of the articulated conduit system 103 on the tug 102 or barge 101 side by offsetting the weight of the pipe segments, joints, couplings and/or other components. For example, rigid pipe section $\mathbf{109}_5$ may be connected to a counterbalance mechanism 111 which is configured to off-set the weight of the extended loading arm. With the weight of the extended loading arm off-set by the counterbalance mechanism 111, a crew member can readily extend the arm out toward the tug and connect the dry break coupling 106 by joining together the tug 102 and barge 101 halves of the dry break coupling 106.

The articulated conduit system is typically secured at the barge 101 and the tug 102. For example, rigid pipe section $\mathbf{109}_4$ may be fixed in place by a support structure $\mathbf{108}_1$ via a pipe mounting bracket. The support structure $\mathbf{108}_1$ may be configured with a vertical support member that provides vertical support, and an angled support member that provides lateral support. One or more support structures $\mathbf{108}_{2\text{-}3}$ may be provided on the tug to secure the articulated conduit system 103. For example, a support structure $\mathbf{108}_2$ may be provided that secures the articulated conduit system 103 in the operational position, and a support structure $\mathbf{108}_3$ may be provided that secures the articulated conduit system 103 in the stowed position on the tug side. A similar support structure configuration may be employed on the barge side.

In preparation for operation, e.g., once the tug enters the notch and the gangway is extended, a crew member may release the articulated conduit system 103 from its stowed position. The crew member may remove weatherproof caps (which may optionally be provided) from the barge and tug halves of the dry break coupling 106A, 106B, rotate the loading arm (the portion of the articulated conduit system 103 that extends from swivel joint $\mathbf{104}_1$ to the barge half of dry break coupling 106A) into position by pulling the arm against a preload in a counterbalance device 106, and connecting the dry break coupling 106 along with the data link connection (not shown). On the tug side, the dry break coupling 106B may be positioned at the Forecastle Deck, e.g., on the starboard side of the tug.

In preparation for stowage, the articulated conduit system 103 may be purged and closed. One or more crew members may decouple the dry break coupling 106 and data link. Optionally, weatherproof caps are placed on the barge and tug halves of the dry break coupling 106A, 106B. The articulated conduit system may be placed and secured in its stowed position (e.g., as shown in FIG. 1N) on the barge 101 and the tug 102. In some configurations, when the arm is disconnected it will automatically return to its stowed position due to a preload in the counterbalance device.

Figure 2A:
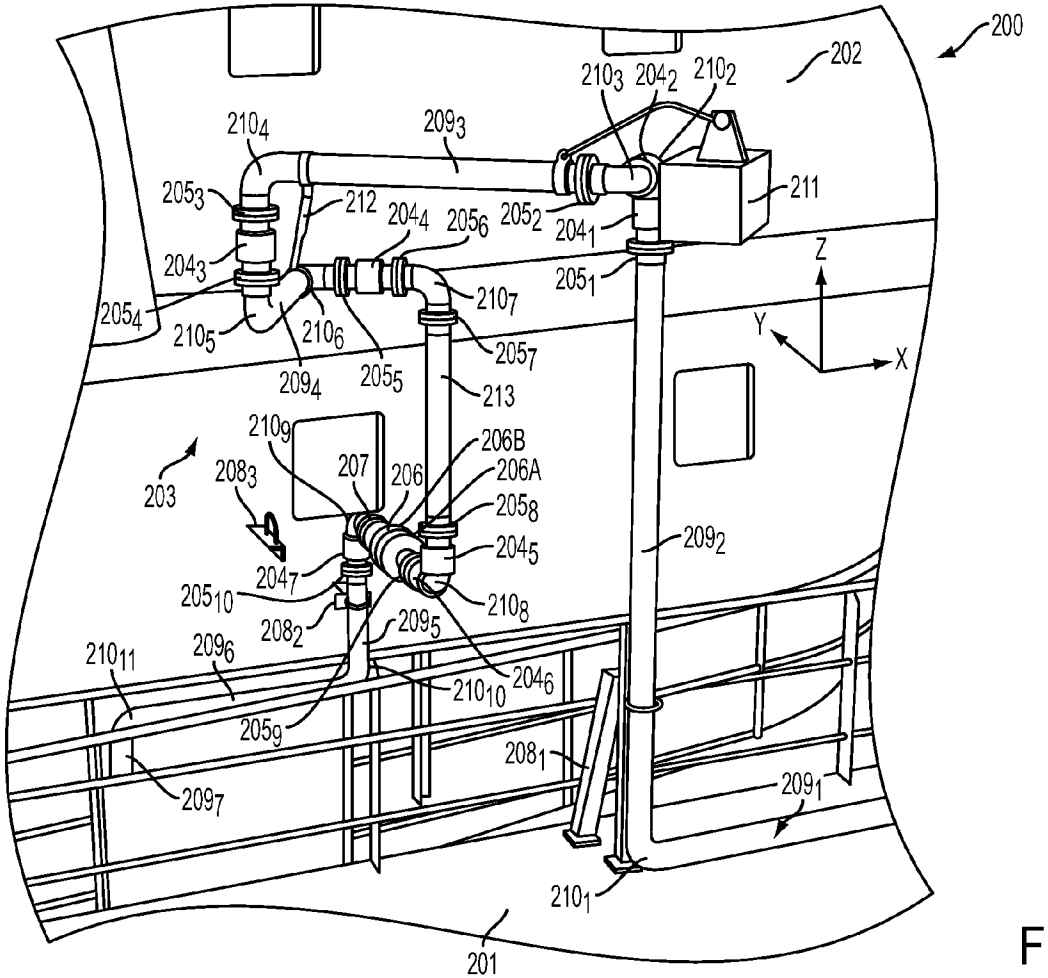
FIG. 2A depicts a perspective view of a non-limiting example of an articulated conduit system configured and arranged in an operational position to transfer gas from a barge to a tug in an ATB vessel.
Figure 2B:
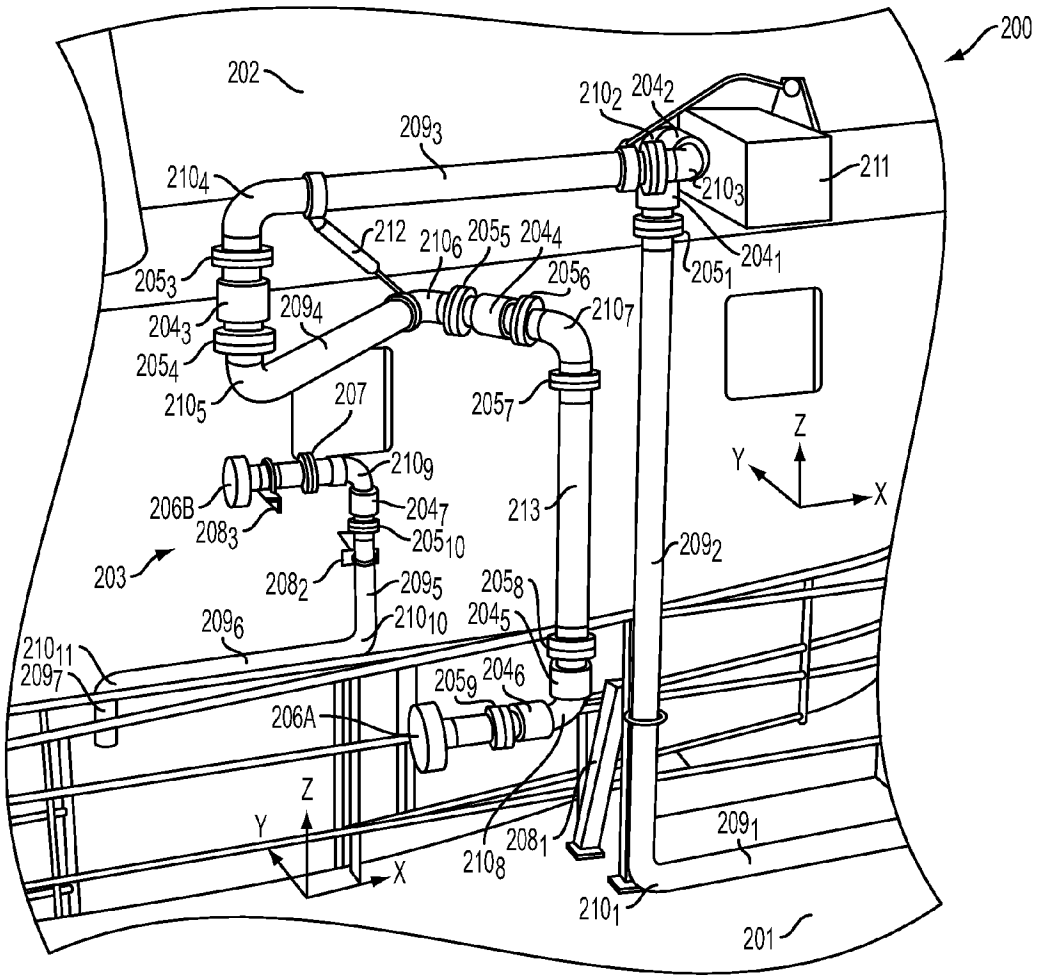
FIG. 2B depicts a perspective view of the articulated conduit system of FIG. 2A in a stowed position.

With reference to FIGS. 2A and 2B, a further non-limiting example of an articulated conduit system 203 for an articulated tug and barge 200. Coordinate systems are provided to facilitate description of the spatial arrangement of the components. FIG. 2A depicts the articulated conduit system 203 in its operational position. FIG. 2B depicts the articulated conduit system 203 in its stowed position.

The articulated conduit system 203 includes rigid pipe segments $\mathbf{209}_{1\text{-}7}$, elbow joints $\mathbf{210}_{1\text{-}10}$, and one flexible hose section 213 interconnected by swivel joints $\mathbf{204}_{1\text{-}7}$. Swivel joint $\mathbf{204}_1$ is oriented in the Z direction and rotates about the Z-axis allowing for displacement in the X and Y directions. Swivel joint $\mathbf{204}_1$ resolves relative motion by allowing for displacement in the X direction. Relative motion between the tug and the barge in the Y direction may be negligible due to the pin connection between the tug and barge. Swivel joints $\mathbf{204}_1$, $\mathbf{204}_3$ and $\mathbf{204}_5$ enables a scissor like displacement that facilitates alignment of the portions of the articulated conduit system 203 connected to the barge 202 and tug 201 for purposes of connecting the two portions (e.g., at a dry break coupling 206). Swivel joint $\mathbf{204}_1$ also allows the barge portion of the articulated conduit system 203 to be rotated between connected and stowed positions.

Swivel joint $\mathbf{204}_2$ is oriented in the X direction and rotates about the X-axis allowing for displacement in the Y and Z directions. Swivel joint $\mathbf{204}_2$ allows the articulated conduit system 203 to articulate in the Y direction, allowing for changes in draft between the two vessels by displacing in the Z direction and enabling connection to be made between the barge 201 and tug 202 portions of the articulated conduit system 203. Displacement in the Z direction allows the arm to accommodate the relative motion between the vessels in the Z direction while the tug pitches.

Swivel joint $\mathbf{204}_3$ is oriented in the Z direction and rotates about the Z-axis allowing for displacement in the X and Y directions. Swivel joint $\mathbf{204}_3$ allows the articulated conduit system 203 to articulate in the Y direction to make the connection between the barge 201 and tug 202 (e.g., at the dry break coupling 206) and allows for displacement in the X direction during pitching motions.

Swivel joint $\mathbf{204}_4$ is oriented in the X direction and rotates about the X-axis allowing for displacement in the Y and Z directions. Swivel joint $\mathbf{204}_4$ allows the articulated conduit system 203 to articulate in the Y direction to make the connection between the barge 201 and tug 202 (e.g., at the dry break coupling 206) for purposes of making the connection, and accommodates changes in draft between the two vessels by allowing the arm to displace in the Z direction. Displacement in the Z direction allows the arm to accommodate the relative motion between the vessels in the Z direction while the tug pitches.

Swivel joint $\mathbf{204}_5$ is oriented in the Z direction and rotates about the Z-axis allowing for displacement in the X and Y directions. Swivel joint $\mathbf{204}_5$ facilitates alignment at the connection point between the tug and barge (e.g., at the dry break coupling 206) and accommodates relative motion in the X direction during pitching motion.

Swivel joint $\mathbf{204}_6$ is oriented in the Y direction and rotates about the Y-axis allowing for displacement in the X and Z directions. Swivel joint $\mathbf{204}_6$ accommodates pitch motion between the tug and barge.

Swivel joint $\mathbf{204}_7$ is oriented in the Z direction and rotates about the Z-axis allowing for displacement in the X and Y directions. Swivel joint $\mathbf{204}_7$ enables the tug arm section to be rotated between the operational and stowed positions, and facilitates alignment at the connection point between the tug and barge (e.g., at the dry break coupling 206) for purposes of making the connection.

In some embodiments, in preparation for operation, e.g., once the tug 202 enters the notch of the barge 201 and a gangway is extended, one or more crew members releases the tug and barge sections of the articulated conduit system 203 from their stowed positions on the tug 202 and barge 201 sides, removes weatherproof caps (which may optionally be provided) from the dry break coupling 206 ends, articulates the arms of the articulated conduit system 203, putting the barge side into position by pulling the arms against the preload in the counterbalance device 211, and connects the dry break coupling 206 (e.g., at the Forecastle Deck on the starboard side of the tug) along with a data link connection (not shown).

In some embodiments, in preparation for stowage, the articulated conduit system 203 is purged and closed. In some embodiments, one or more crew members decouples the dry break coupling 206 and data link. Optionally, weatherproof caps are placed on the dry break coupling 206 ends. The articulated conduit system 203 is placed and secured in its stowed position on the barge 201 and the tug 202. In some embodiments, when the barge portion of the articulated conduit system 203 is disconnected it will automatically return to its stowed position due to a preload in the counterbalance device 211. In some embodiments, when the articulated conduit system 203 is not in use it will be maintained in its stowed position as shown in FIG. 2B.

Flange joints $\mathbf{205}_{1\text{-}9}$ or other joints are provided to connect components of the articulated conduit system 203. The articulated conduit system 203 may also include a dry break coupling 206 and/or a breakaway coupling 207, as illustrated. In addition, support structures $\mathbf{208}_{1\text{-}3}$ may be provided to secure the articulated conduit system 203 on the barge 201 and tug 202. A counterbalance device 211 and/or spring support device 212 may also be provided to off-set the weight of the extended articulated conduit system While a spring support device 212 is shown, it should be appreciated that other support devices may be used. For example, the support device may comprise a gas cylinder, hydraulic cylinder, pneumatic cylinder or other load bearing mechanism. The support device is typically configured to cause automatic rotation of the barge portion of the articulated conduit system 203 from an operational position to a stowed position when the articulated conduit system 203 is disconnected, e.g., at the dry break coupling 206 or breakaway coupling 207. The support device may be configured and arranged such that the articulated conduit system 203 will clear the rail of a tug when it rotates from the operational to stowed position during an emergency tug barge disconnect. The support device may be configured and arranged such that the articulated conduit system 203 is easy and simple to operate by as few as one crew member. The support device may be configured and arranged such that an operator will experience little resistance while connecting the articulated conduit system 203.

Figure 3A:
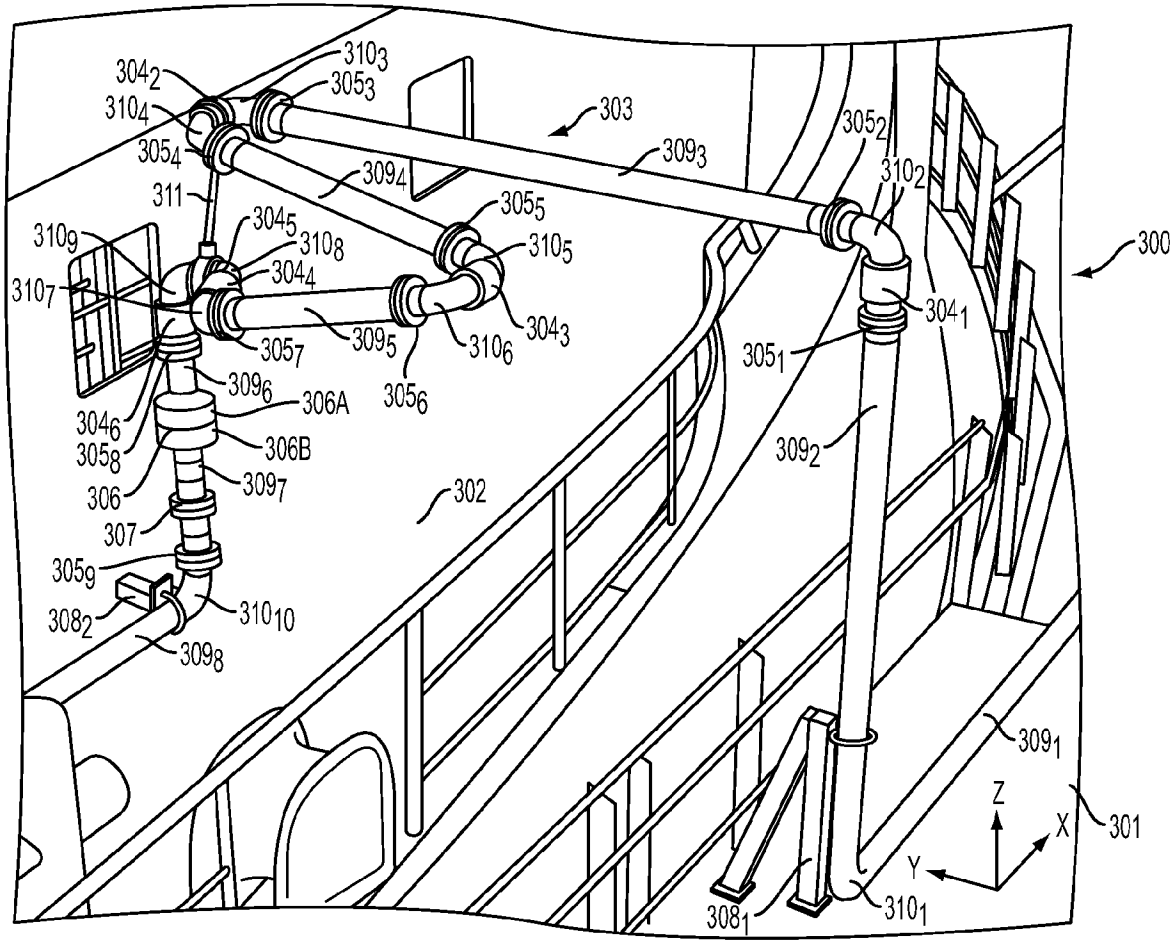
FIG. 3A depicts a perspective view of a non-limiting example of an articulated conduit system configured and arranged in an operational position to transfer gas from a barge to a tug in an ATB vessel.
Figure 3B:
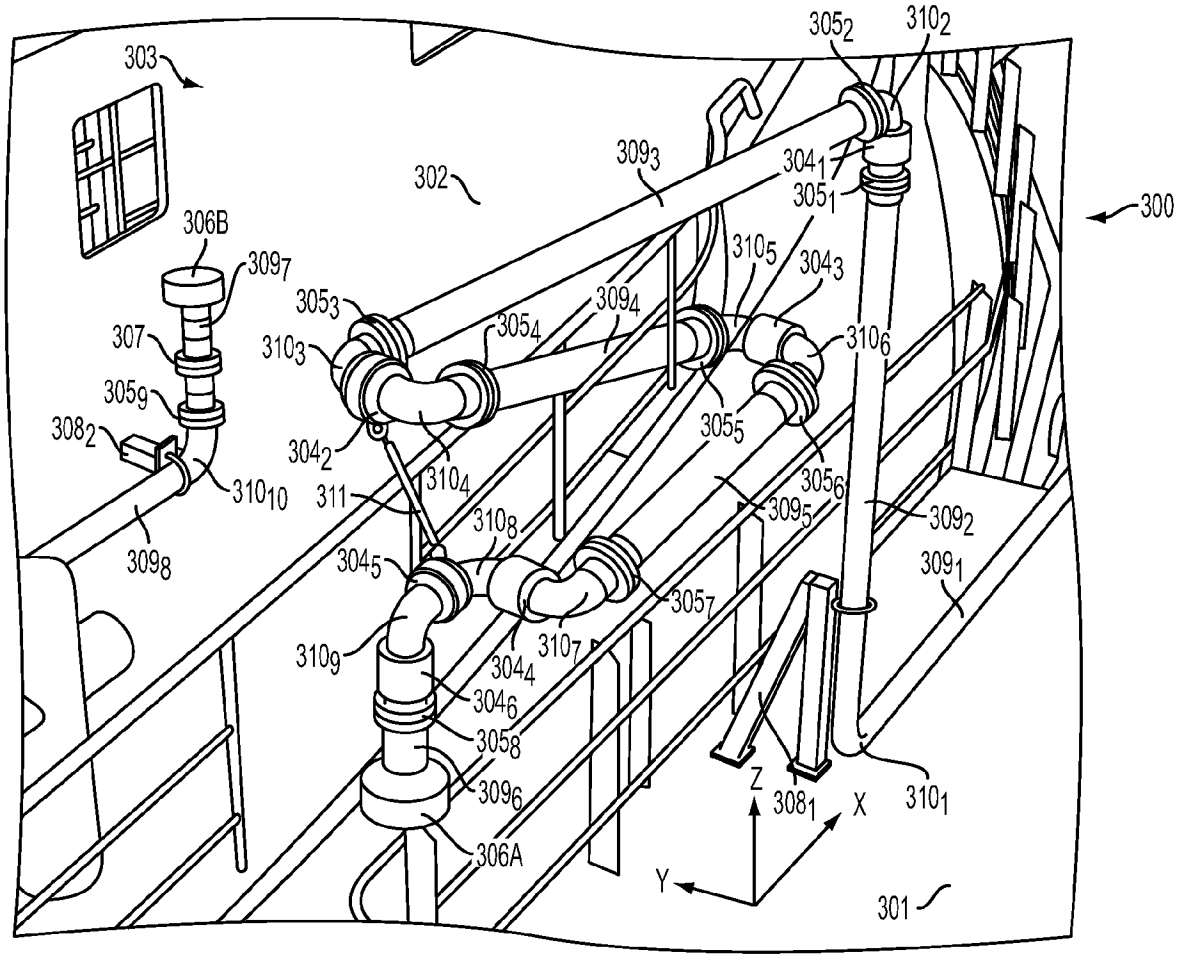
FIG. 3B depicts a perspective view of the articulated conduit system of FIG. 3A in a stowed position.

With reference to FIGS. 3A and 3B, a further non-limiting example of an articulated conduit system 303 is provided for an articulated tug and barge 300. Coordinate systems are provided to facilitate description of the spatial arrangement of the components. FIG. 3A depicts the articulated conduit system 303 in its operational position. FIG. 3B depicts the articulated conduit system 303 in its stowed position. The articulated conduit system 303 includes rigid pipe segments $\mathbf{309}_{1\text{-}8}$ and elbow joints $\mathbf{310}_{1\text{-}10}$ interconnected by swivel joints $\mathbf{304}_{1\text{-}6}$.

Swivel joint $\mathbf{304}_1$ is oriented in the Z direction and rotates about the Z-axis allowing for displacement in the X and Y directions. Swivel joint $\mathbf{304}_1$ allows the entire arm to be rotated into the operational position and back to the stowed position. Swivel joint $\mathbf{304}_1$ resolves relative motion by allowing for displacement in the X direction.

Swivel joints $\mathbf{304}_{2\text{-}4}$ are oriented in the X direction and rotate about the X-axis allowing for displacement in the Y and Z directions. Swivel joints $\mathbf{304}_{2\text{-}4}$ allow the arm to articulate in the Y direction to make the connection between the barge and tug (e.g., at the dry break coupling 306) and allow for the change in draft between the two vessels by displacing in the Z direction. Displacement in the Z direction allows the arm to handle the relative motion between the vessels in the Z direction while the tug pitches. Swivel joints $\mathbf{304}_2$, $\mathbf{304}_3$ and $\mathbf{304}_4$ enables a scissor like displacement that facilitates alignment of the connection point between the tug and barge (e.g., alignment of the barge and tug halves of a dry break coupling 306A, 306B) and accommodate displacement in the Z and Y directions with the latter displacement typically being minimal when the pin connection is made between the tug 302 and barge 301.

Swivel joint $\mathbf{304}_5$ is oriented in the Y direction and rotates about the Y-axis allowing for displacement in the X and Z directions. Swivel joint $\mathbf{304}_6$ is oriented in the Z direction and rotates about the Z-axis allowing for displacement in the X and Y directions. Swivel joint $\mathbf{304}_6$ allows for relative motion in the X direction during pitching motion. Thus, swivel joint $\mathbf{304}_6$ accommodates the pitch motion between the tug and barge.

In the configuration depicted in FIG. 3A-B, the tug half of the dry break coupling 306B is secured to the tug (e.g., via support structure $\mathbf{308}_2$), which simplifies alignment and connection of the dry break coupling 306. A support structure $\mathbf{308}_1$ is provided on the barge 301 to secure the articulated conduit system 303 to the barge 301.

Flange joints $\mathbf{305}_{1\text{-}9}$ or other joints may be provided to connect components of the articulated conduit system 303.

The articulated conduit system 303 main arm may be self-supporting, and a counterbalance device may not be provided. In FIG. 3A-B, a spring support device 311 is included to provide support between sections of the articulated conduit system 303 and minimize or dampen loads (dynamic and/or static) that are imparted during operation on components of the articulated conduit system 303, including pipe segments $\mathbf{309}_{1\text{-}8}$ and elbow joints $\mathbf{310}_{1\text{-}10}$, for example.

It should be appreciated that the embodiments depicted in FIGS. 1A-3B are not limiting and alternative configurations of the articulated conduit systems (e.g., utilizing at least 6 swivel joints) can be used.

In some embodiments, during normal operations, articulated conduit systems disclosed herein will experience constant motion as the tug and barge pitch separately about a pin axis (e.g., an Intercon pin access). The motion results in a rotation and displacement at the tug connection interface. This constant motion environment is not generally seen by the loading arms used in other contexts (e.g., for road and rail cargo loadings) where vehicles are static during loading operations. It should be appreciated that the magnitude and frequency of the pitch motion will vary depending on the sea conditions. In some embodiments, the articulated conduit system is configured to function for extended durations under constant motion resulting from differential movement between the tug and barge even though the magnitude normal displacement may be relatively low. In some embodiments, the articulated conduit systems is designed to accommodate differential movement between the tug and barge encountered during transit in inland waters, including canals, lakes, rivers, water courses, inlets, and bays. In some embodiments, the articulated conduit systems is designed to accommodate differential movement between the tug and barge encountered during oceangoing transit.

Figure 4:
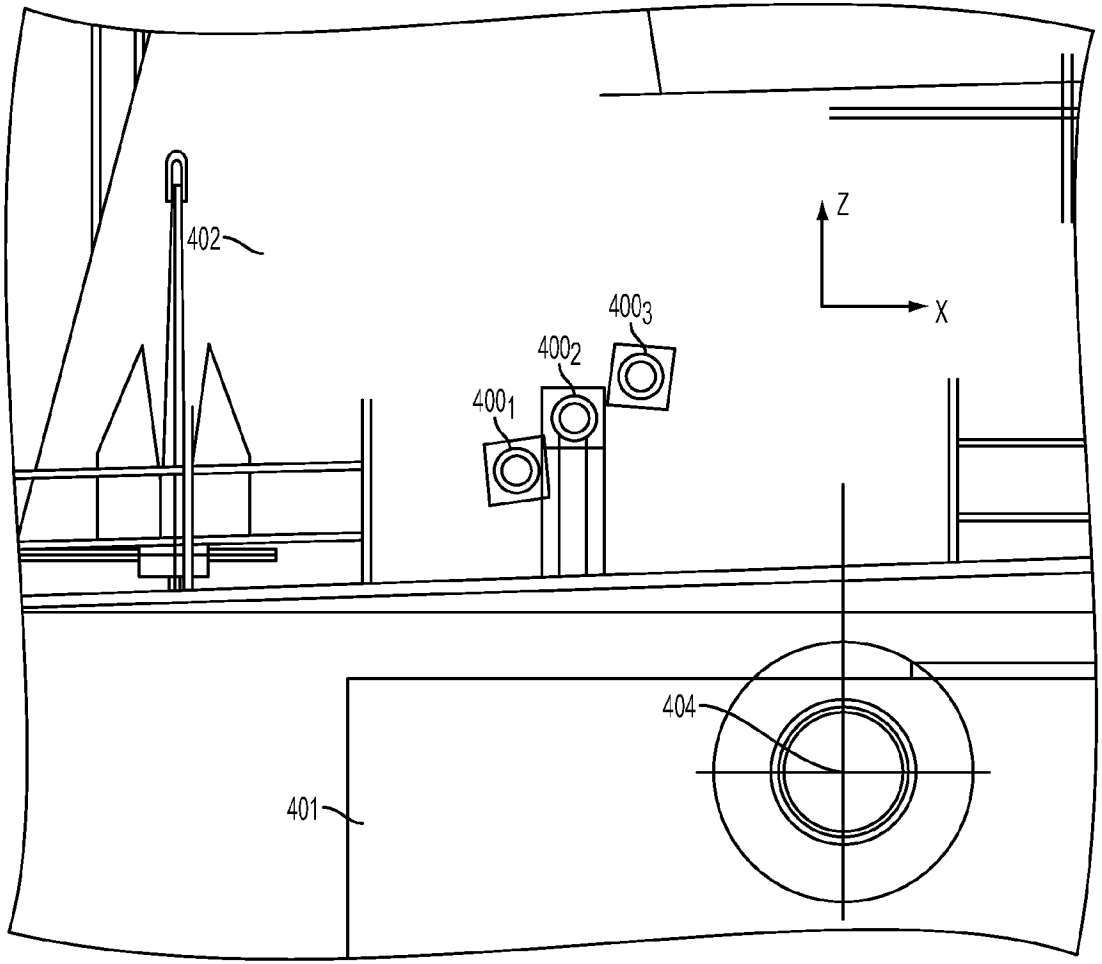
FIG. 4 depicts a side view of relative pitch motion between a tug and barge of an ATB vessel.

In some embodiments, the articulated conduit system is configured to function for extended durations under constant motion resulting from differential movement between the tug and barge that result from ocean conditions associated with a Beaufort wind force scale rating of up to 1, up to 2, up to 3, up to 4, up to 5, up to 6, up to 7, up to 8, up to 9, up to 10, up to 11, or up to 12. By way of example, FIG. 4 depicts changes in positioning of a dry break coupling $\mathbf{400}_{1\text{-}3}$, which serves as a main gas connection between a tug and barge, at different relative pitch positions between a barge 401 and tug 402 that may be expected in ocean conditions associated with a Beaufort wind force scale rating of about 8. In particular, the position of the dry break coupling $\mathbf{400}_{1\text{-}3}$ is shown at +10 degrees, 0 degree and −10 degrees of rotation about the ATB pin connection 404.

In some embodiments, to minimize the pitch displacement encountered by the articulated conduit system as a result of pitch motion, the articulated conduit system is configured such that the centerline of the conduit section extending transversely from the barge toward the tug and/or the tug toward the barge is longitudinally positioned relatively close to the pin centerline. In some embodiments, the articulated conduit system is configured such that the centerline of the conduit section extending transversely from the barge toward the tug and/or the tug toward the barge is longitudinally positioned within 1 ft., 2 ft., 3 ft., 4 ft., 5 ft., 6 ft., 7 ft., 8 ft., 9 ft., or 10 ft. of the pin centerline.

As disclosed above, articulated conduit systems typically include a plurality of fluid conduits interconnected by rotatable joints, e.g., swivel joints. It should be appreciated that the fluid conduits may include one or more of a pipe segment, a flange joint, a flexible hose (e.g., a flexible steel hose), a dry break coupling, and a breakaway coupling. Use of a flexible hose may be advantageous because it facilitates dissipation of vibrational forces in the articulated conduit system. In some embodiments, flexibility of the flexible hose section reduces stresses in components of the articulated conduit systems, including couplings, swivels, pipe sections, etc. In some embodiments, flexibility of the flexible hose section accommodates small amount of misalignment between components of the articulated conduit system.

The articulated conduit systems disclosed herein may be configured and arranged to facilitate ease of removal and replacement of their component parts, including, e.g., swivel joints, flexible hoses (e.g., flexible steel hoses), dry break couplings, pipe segments, etc. Flange joints may be included to allow easy replacement of components of the systems, including removal of components, for onboard servicing. The use of flange joints may be advantageous because components can be readily removed and replaced or installed relatively quickly allowing for minimum out of service time. In some embodiments, each or any pipe segment, hose, dry break coupling, breakaway coupling, etc. included in the articulated conduit system uses flanged ends to facilitate removal and replacement. However, it should be appreciated that each or any of the flange joints disclosed herein above may optionally be another type of joint, e.g., a welded joint, etc.

It should also be appreciated that pipe segments of any of a variety of sizes and types may be used. In some embodiments, a pipe segment has a nominal pipe size (NPS) of up to 1 inch, 1.5 inch, 2 inch, 2.5 inch, 3 inch, 3.5 inch, 4 inch, 5 inch, 6 inch, 7 inch, 8 inch, 9 inch, 10 inch, 16 inch, 18 inch or more. In some embodiments, the pipe segment has a wall thickness of schedule 5, 10, 20, 30, 40, 60 or more. In some embodiments, pipe segments are made of steel, stainless steel, aluminum, cast iron, brass or other suitable material. In some embodiments, pipe segment sizes are minimized to reduce the weight of the system yet provide enough strength to handle the static and dynamic loads encountered in operation.

Also, in some embodiments, any of a range of flexible metallic hose and composite hoses may be used in combination with pipe segments that would be suitable for an articulated conduit system (suitable examples are available from US Hose Corporation in Romeoville, Ill.)

In some embodiments, the size of pipe segments and other components of the system are set by the maximum allowable pressure drop between the barge and tug (e.g., between the barge and the tug main propulsion generators). In some embodiments, the maximum allowable pressure drop between the barge and tug is in a range of 0.1 atm to 2 atm, 0.5 atm to 2 atm, 0.5 atm to 5 atm, 1 atm to 2 atm. In some embodiments, the maximum allowable pressure drop between the barge and tug is up to 0.1 atm, 0.5 atm, 1 atm, 2 atm, 3 atm, 4 atm, 5 atm. In some embodiments, the number and types of system components (e.g., breakaway and dry break couplings, swivel joints) are considered in evaluating the extent of pressure drop through the articulated conduit system for purposes of sizing pipe. In some embodiments, engine response time is also a consideration when sizing the articulated conduit system.

Pipe segments and other components of the conduit system may be assembled by any suitable connections, including, for example, welded, and/or flanged joints. Systems may also include one or more of elbow joints (e.g., 90°, 45° elbows), couplings, nipples, inspection port adaptors, crosses, tees, reducers, caps, etc.

The articulated conduit system may be secured on the barge, at least in part, through a joint (e.g., a welded joint, a flanged joint) that fluidically connects the conduit system with a fluid supply system on the barge. The supply system may comprise conduits for supplying fluids (e.g., fuel gas) to the articulated conduit system from a storage vessel (e.g., a fuel gas storage vessel). The supply system may comprise a gas valve unit or gas pressure reducing regulating station. One or more gas valve units (GVUs) may be located on the barge. Each GVU is a module between the LNG storage system and the tug engine that regulates base gas pressure, and provides certain safety features such as, for example, fast shutdown of the gas system if needed. Typically, there may be one or more GVU on the barge or tug serving each fuel gas consumer (e.g., each engine) on the tug depending, for example, on desired redundancy. The GVU may include a pressure regulating valve that maintains a near constant gas supply pressure. In some embodiments, the gas supply pressure is in a range of 0.01 atm to 0.5 atm, 0.01 to 1 atm, 1 atm to 3 atm, 1 atm to 5 atm, 3 atm to 5 atm, 3 atm to 7 atm, 5 atm to 7 atm or 5 atm to 10 atm. In some embodiments, the gas supply pressure is up to 0.01 atm, up to 0.5 atm, up to 1 atm, up to 2 atm, up to 5 atm, up to 10 atm. In some configurations, gas supply valves are provided in the GVU that respond to engine load variations on the tug by increasing or reducing fuel gas flow to the engines on the tug. The GVU pressure regulating valve then responds to the change in gas flow rate. It should be appreciated that the volume of gas in the conduits between the GVU and tug engines may influence the response time of the system to changes in engine load.

The articulated conduit system may be secured on the tug, at least in part, through a joint (e.g., a welded joint, a flanged joint) that fluidically connects the conduit system with a fluid intake system on the tug. In some configurations, the fluid intake system comprises a fuel supply conduit for a tug engine. The tug engine may directly drive the propulsion system of the tug or it can power a generator which in turn powers electrical motors of the propulsion system. The conduit may also supply fuel gas to other engines, including engines for main or emergency back-up generators that supply power to the tug other than power for propulsion (e.g., power for lighting, pump motors, fire protection system, monitoring and control systems, outlets, etc.). However, it should be appreciated that the fuel gas on the tug may be used for any suitable purposes, including for example, as fuel gas for heating or other purposes.

The articulated conduit systems provided herein may comprise suitable communication, electrical and data link components to monitor and/or control operation of the system and/or transport of gas between the tug and barge. Control and/or monitoring components may be provided at each end of the articulated conduit system. Control, alarm, and monitoring data links may be provided that extend between the tug and barge. A control system may be provided that comprises a wireless connection system and a redundant hard-wired connection system. A data link may be provided that handles monitoring and control. A control system (e.g., a Wartsila control system) may be provided to monitor and control a GVU onboard the barge or tug.

Hard wired data link connections and other communication or electrical components are typically intrinsically safe and/or configured and arranged to function while exposed to environmental insults, e.g., seawater exposure, foul weather, hazardous environment, etc. The connections may be dust tight and water tight (e.g., up to a 3 meter immersion). Furthermore, the data link connections and other communication or electrical components that pass between the tug and barge may be configured to be capable of breaking away without damage during an emergency decoupling of a tug and barge. Such connections may disengage if an axial pull force above a certain threshold level is applied, thus protecting the electrical conductors from damage.

It should be further appreciated that the articulated conduit system provided herein may be designed to operate over a range of temperatures and weather conditions (e.g., ranging from the extreme summer conditions of the Gulf of Mexico to the extreme winter conditions of the Great Lakes.) The system may also be configured to function across a range of temperature and weather conditions during normal, coupled operation where fuel gas is being actively transferred from the barge to the tug. The system may also be configured to function across a range of temperature and weather conditions during the physical coupling/decoupling of the connection. The articulated conduit system is designed to operate under foul weather conditions (e.g., including rain, ice, and snow) for extended periods of time. Typically, components of the articulated conduit system (e.g., pipe segments, couplings, swivel joints) are designed to resist corrosion.

The articulated conduit system may be configured with a small structural awning or other similar structure to provide overhead impact protection from falling objects and some degree of protection from weather. The awning may be sized to cover at least the breakaway coupling and dry break coupling, which may be vulnerable components of the articulated conduit system in some configurations. An awning is provided on the barge and/or tug to protect the system in the stowed position. In some embodiments, the awning is designed such that it will not allow for the containment of any gaseous vapors that may become present during coupling or decoupling.

EXAMPLES

Example 1

Articulated Conduit System on a Liquefied Natural Gas (LNG) Articulated Tug Barge (ATB)

The tug is a dual fuel vessel that is intended to utilize gaseous natural gas as a fuel gas to supply the main propulsion generator engines while coupled to the barge. The fuel gas is supplied to the tug from the barge via an articulated conduit system capable of handling the relative motions between the tug and barge.

| Tug Characteristics: | |
|---|---|
| Length Overall | 100'-0" |
| Breadth | 38'-0" |
| Depth at Side, Midship | 18'-4" |
| Design Draft to DWL | 13'-6" |
| Barge Characteristics: | |
| Length Overall | 241-8" |
| Breadth | 60'-0" |
| Depth at Sides | 23'-6" |
| Full Load Draft (approx.) | 15'-0" |
| Ballasted Draft (approx.) | 12'-0" |

Natural Gas Supply Characteristics:

The natural gas is in a gaseous state as it flows from the barge to the tug. Natural Boil Off Gas (BOG) from the barge LNG storage tanks is consumed, with any additional fuel gas demand provided by two fuel gas vaporizers located on the barge. Note that, for this example, based on the required minimum supply pressure requirement the maximum allowable pressure drop from the fuel gas buffer vessel on the barge to the Gas Valve Unit (GVU) on the barge or tug is approximately 1.3 bar (gauge).

TABLE 1

Fuel Gas Conditions

| Parameter | Value |
|---|---|
| Temperature | 0 < temperature < 60° C. |
| Pressure | Minimum supply pressure to Gas Valve Unit (GVU) on barge: 6.7 bar (absolute) Discharge pressure from boil off gas (BOG) compressors on barge: 8.0 bar (absolute) |
| Energy Content | Minimum energy content: Lower Heating Value (LHV) > 28 MJ/m$^3$ Nominal energy content: LHV = 68.3 MJ/m$^3$ (at 0° C. and atmospheric pressure) |
| Flow Rate | Using minimum energy content fuel gas: 428 m$^3$/hr Using nominal energy content fuel gas: 240 m$^3$/hr (at 0° C. and atmospheric pressure) |

Relative Motion Range:

The draft range of the barge as well as relative pitch motion between the tug and barge in a sea way are accommodated by the articulated conduit system. Pitch range is characteristic of a survival sea state (Beaufort Level 8). The following are the ranges for vertical draft range and pitch range.

Maximum Draft Barge (full cargo): 14.91 ft

Minimum Draft Barge (light service draft—with ballast): 11.85 ft

Design Draft Range (includes 25% margin): 3.83 ft

Pitch Range: +/−10 degrees

This pitch range results in the following total displacement at the fuel gas connection fitting location on the tug:

Longitudinal: 25 in

Vertical: 19 in

The fuel gas connection is located on the Forecastle Deck level, starboard side on the tug. The fuel gas connection is located near the Intercon pin location to minimize relative motion due to pitch. The connection is provided with overhead physical protection and arranged to be clear of any potential damage while the tug is maneuvering into or out from the barge notch.

The connection operates over a range of temperatures and weather conditions from the extreme summer conditions of the Gulf of Mexico to the extreme winter conditions of the Great Lakes, though other extremes are contemplated, such as operation near the equator or near the arctic circle. Operation includes normal, coupled operation and the physical coupling/decoupling of the connection. Design weather conditions include rain, ice, and snow. The maximum design ambient air temperature is 45° C. (113° F.). The minimum design ambient air temperature is −30° C. (−22° F.).

The articulated conduit system is configured and arranged such that it can be coupled/decoupled by a single crew member. The articulated conduit system can decouple without human intervention in an emergency situation. A self-sealing dry break style coupling is used for normal connection operation.

The articulated conduit system utilizes an additional break-away connector in series with the normal dry break coupling for use in an emergency situation. The break-away coupling is designed to automatically decouple, without irreparable damage, at a threshold force value that would result from the tug attempting to leave the notch. If the tug leaves the barge notch rapidly where there is no time for a normal shut down and normal decoupling evolution utilizing the dry-break coupling, the break-away coupling minimizes a release of gas vapors. An auto-closing, double valve arrangement seals off both ends of the line at the break point.

The tug and barge is configured and arranged to allow transfer of control and monitoring signals and commands between the tug and the barge. The data link design provides redundant hard wired connection and wireless connection. The data link handles connections for monitoring and control system to gas valve units (GVU) onboard the barge or tug. A connection indicator system is provided to indicate that the articulated conduit system is mechanically secure prior to activating the fuel gas transfer system.

A micro-processor monitoring and control system is installed on the tug and barge with three display and control stations:

Barge Control Room

Tug Bridge

Tug Engine Room

The fuel gas system cargo compressors, fuel gas/spray pumps, and water/glycol pumps serving the compressor intercoolers and aftercoolers have remote start/stop from the display and control systems. Monitoring and alarm points for LNG cargo transfer and fuel gas system are available at each of the three display and control stations.

Example 2

Operation Sequences for an Articulated Conduit System on a LNG ATB

An operation sequence is provided below for an articulated conduit system that is installed on a LNG ATB.

Coupling of the Articulated Conduit System and Establishing Fuel Gas Operation on Board the Tug Involves the Following:

1) The tug approaches the barge while the tug is operating on diesel fuel. The tug's main propulsion generators remain online as it approaches the barge.

2) The tug enters the notch at the stern of the barge. Once inside the notch, the Intercon pins extend from the tug and enter corresponding recesses provided within the stern notch of the barge. The crew confirms a positive link once the pins have entered the recesses.

3) The crew then starts the barge generators and brings barge power online. The fuel gas system onboard the barge is started for automatic operation, and operating pressure in a fuel gas buffer vessel is established and maintained. The fuel gas buffer vessel stores gas that is supplied via the articulated conduit system to the tug.

4) The crew then connects a dry break coupling, which serves as a fuel gas connection at Forecastle Deck on the tug, and which establishes a sealed articulated conduit through which fuel gas flows from the barge to the tug. An alarm and monitoring system provides confirmation that a proper dry break fuel gas connection has been made.

5) The crew then connects a data link between tug and barge that permits monitoring and control of the fuel gas system.

6) Control of fuel gas system on the barge is established from the tug, and a barge alarm and monitoring system is established on the tug.

7) A fuel gas vent valve, which serves as a connection line between a GVU on the barge and the tug main propulsion engines is closed. Fuel gas isolation valves serving each main propulsion generator on the tug are opened.

8) A fuel gas master valve on the barge is opened, allowing fuel gas to flow from the fuel gas buffer vessel on the barge to the GVU on the barge or tug.

9) The tug is transferred from diesel to gas operating mode, which involves closing of the tug main propulsion generator on-engine venting valves and the GVU vent valves, and opening of double block shut off valves in the GVU.

10) With fuel gas being supplied, the tug main propulsion generators are operating in fuel gas operating mode.

Underway Operation:

During underway operation, the tug main propulsion generators continue running in gas operating mode unless, for example, a problem with the system is encountered, in which case the propulsion generators can be shifted to diesel operation. In normal operation, the fuel gas system on the barge automatically maintains the required gas supply to the tug. An annular space in double wall gas supply piping provided in the tug is continually ventilated mechanically by fans. Alarm and monitoring systems on the barge and on the tug remain active.

Decoupling of the Articulated Conduit System Involves the Following:

1) Prior to decoupling of the articulated conduit system, the tug is transferred from gas to diesel operating mode, such that the main propulsion generators remain online in diesel mode.

2) The system components (e.g., the fuel gas connection downstream of the GVU and all fuel gas piping on the tug, including the on-engine gas manifold) are purged with an inert gas (e.g., nitrogen). The Fuel Gas Master Valve is closed and fuel gas remaining in the connection line is purged to a safe location via automated opening of the inert gas supply line isolation valves and GVU system vent valves. Fuel gas vent valves serving the connection line between the GVU on the barge or tug and the tug main propulsion engines are opened. Fuel gas isolation valves serving each main propulsion generator on the tug are closed.

3) The dry break coupling and data link are decoupled, and weatherproof caps are placed on both sides of the dry break connection. The articulated conduit system is moved to a stowed position, and stowed on the barge.

4) Barge generators and fuel gas system are secured.

5) The Intercon pins of the tug retract from the recesses in the barge notch.

6) The tug backs out of notch.

The sequence above involves a post-purge using inert gas when the articulated conduit system is coupled. During a temporary engine stop or transfer to diesel operating mode, the articulated conduit system line may not be purged with inert gas.

Emergency Operations

The tug may exit the notch in an emergency situation where there is not enough time to perform the normal decoupling sequence. In this case, a breakaway coupling allows separation of the fuel gas line without irreparable damage. The breakaway coupling automatically seals itself preventing or minimizing gas leakage. Also, the articulated conduit system is designed to prevent fouling with the tug as it exits the notch. An electronic breakaway connector for the data link is provided that allows separation without irreparable damage.

Configurations Relating to System Safety

In some embodiments, the engines may be configured to automatically transfer to diesel mode in the event that there is failure of the fuel gas supply system on barge. In the event of an automatic transfer of this nature, the propulsion power may be uninterrupted.

In some embodiments, the gas system control from the tug may be interrupted in the event that there is a data link failure between barge and tug. In the case of a data link failure alarm and monitoring system function on the tug may be interrupted. In some embodiments, system may be configured such that fuel gas supply to the tug will be automatically shut down in the event of a data link failure.

In some embodiments, one or more gas sensors may be provided at or near joints (e.g., swivel joints) or other components of the articulated conduit system to detect fuel gas release (e.g., due to mechanical failure, rupture or other conditions leading to leaks). A monitoring system may be provided that compares pressure at outlet of GVU to supply pressure at the tug main propulsion generator gas manifolds, and sends an alarm if pressure drop exceeds a maximum expected, indicating leakage at some point in the system. Fuel gas supply to the tug may be automatically stopped if any of the alarms or sensors are tripped.

In some embodiments, the fuel gas system may be operated such that a leak test (e.g., an automated leak test) is performed prior to engine transfer to gas operating mode. If the leak test indicates any unwarranted leakage from the system, the engine may be blocked from transferring to gas operating mode and the gas supply to the GVU may be stopped.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present invention.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified unless clearly indicated to the contrary. Thus, as a non-limiting example, a reference to "A and/or B," when used in conjunction with open-ended language such as "comprising" can refer, in one embodiment, to A without B (optionally including elements other than B); in another embodiment, to B without A (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

What is claimed is:

1. An articulated tug and barge (ATB) arrangement comprising:

a tug;

a barge; and an articulated conduit system for transferring a fuel gas between the tug and the barge, wherein the tug is positioned within a notch at the stern of the barge, and wherein the tug is configured to push the barge through a pin connection, and wherein the articulated conduit system comprises a first end on the tug and a second end on the barge, wherein the first and second ends are connectable through a plurality of rigid conduits fluidically interconnected by swivel joints that accommodate different movement between the tug and barge, wherein the swivel joints comprise i) at least three swivel joints each having an axis of rotation substantially parallel to a forward-aft axis of the tug such that each of the at least three swivel joints is rotatable about its axis of rotation in a substantially port-starboard plane, wherein together the at least three swivel joints are rotatable in their substantially port-starboard planes to accommodate relative vertical displacement between the tug and barge and relative rotation between the tug and barge about the forward-aft axis of the tug, and ii) at least one swivel joint having an axis of rotation substantially parallel to a port-starboard axis of the tug such that the at least one swivel joint is rotatable about its axis of rotation in a substantially forward-aft plane to accommodate pitch motion between the tug and barge.

2. The ATB arrangement of claim 1, wherein the swivel joints further comprise at least one swivel joint configured to permit at least a portion of the conduit system to be rotated between a stowed position and an operational position that extends from the tug to the barge.

3. The ATB arrangement of claim 2, wherein the at least one swivel joint configured to permit rotation between the stowed position and the operational position that extends from the tug to the barge has an axis of rotation substantially parallel to a vertical axis of the tug such that the at least one swivel joint is rotatable about its axis of rotation in a yaw plane of the tug to permit the portion of the conduit system to be rotated between the stowed position and the operational position that extends from the tug to the barge.

4. The ATB arrangement of claim 1, wherein the swivel joints further comprise at least one swivel joint configured to permit at least a portion of the conduit system to be rotated between a stowed position and an operational position that extends from the barge to the tug.

5. The ATB arrangement of claim 4, wherein the at least one swivel joint configured to permit rotation between the stowed position and the operational position that extends from the barge to the tug has an axis of rotation substantially parallel to a vertical axis of the barge such that the at least one swivel joint is rotatable about its axis of rotation in a yaw plane of the barge to permit the portion of the conduit system to be rotated between the stowed position and the operational position that extends from the barge to the tug.

6. The ATB arrangement of claim 1, wherein the pin connection is a single degree of freedom pin connection within the barge notch, that establishes a transverse, fixed axis between the tug and barge, about which the tug and barge are allowed pitch rotation.

7. The ATB arrangement of claim 1, wherein the barge is configured for storing the fuel gas as a liquid and to direct boil off gas produced from the liquid through the articulated conduit system to the tug to serve as fuel gas for the tug.

8. The ATB arrangement of claim 1, wherein the barge is configured for storing the natural gas as liquid natural gas (LNG), and to direct boil off gas produced from the LNG through the articulated conduit system to the tug to serve as fuel gas for the tug.

9. The ATB arrangement of claim 1, wherein the system is secured at the first and second ends through joints that fluidically interconnect the system with first and second immobilized pipe segments on the tug and barge, respectively.

10. The ATB arrangement of claim 9, wherein the first immobilized pipe segment is in fluid communication with a fuel gas intake system of the tug.

11. The ATB arrangement of claim 10, wherein the fuel gas intake system comprises a main engine fuel supply conduit.

12. The ATB arrangement of claim 9, wherein the second immobilized pipe segment is in fluid communication with a fuel tank on the barge.

13. The ATB arrangement of claim 1, wherein the articulated conduit system is configured to enable the fuel gas to power a propulsion system of the tug.

14. The ATB arrangement of claim 11, wherein the articulated conduit system is configured to enable the fuel gas to serve as fuel for combustion in an engine of the propulsion system.

15. The ATB arrangement of claim 14, wherein the engine is a propulsion engine that mechanically operates a propeller of the tug.

16. The ATB arrangement of claim 14, wherein the engine is coupled to an electric generator that powers an electric propulsion motor of the tug.

17. The ATB arrangement of claim 1, wherein the fuel gas is natural gas.

18. A method of operating an articulated tug and barge (ATB) arrangement comprising a tug, a barge, and an articulated conduit system for transferring a fuel gas between the tug and the barge, wherein the tug is positioned within a notch at a stern of the barge, and wherein the tug is configured to push the barge through a pin connection, and wherein the articulated conduit system comprises a first end on the tug and a second end on the barge, wherein the first and second ends are connected through a plurality of rigid conduits fluidically interconnected by swivel joints that accommodate different movement between the tug and barge, wherein the swivel joints comprise i) at least three swivel joints each having an axis of rotation substantially parallel to a forward-aft axis of the tug such that each of the at least three swivel joints is rotatable about its axis of rotation in a substantially port-starboard plane, wherein together the at least three swivel joints are rotatable in their substantially port-starboard planes to accommodate relative vertical displacement between the tug and barge and relative rotation of the tug and barge about the forward-aft axis of the tug, and ii) at least one swivel joint having an axis of rotation substantially parallel to a port-starboard axis of the tug such that the at least one swivel joint is rotatable about its axis of rotation in a substantially forward-aft plane to accommodate pitch motion between the tug and barge, the method comprising:

transferring the fuel gas between the tug and barge through the articulated conduit system.

19. The method of claim 18, wherein the articulated conduit system is secured at the first end through a joint that fluidically connects the articulated conduit system with a fuel gas intake system of the tug, and wherein the method comprises transferring the fuel gas from the barge through the articulated conduit system to the fuel gas intake system of the tug.

20. The method of claim 19, wherein the fuel gas intake system is configured to supply fuel gas to an engine of a propulsion system of the tug, and wherein the method further comprises supplying the fuel gas to the engine through the fuel gas intake system to power the engine.

21. The method of claim 19, wherein the method further comprises transferring fuel gas from the barge to the tug, wherein the fuel gas transferred to the tug is boil-off gas produced from a liquid stored on board the barge.

22. The method of claim 21, wherein the liquid is liquid natural gas (LNG).

23. The method of claim 18, wherein the fuel gas is natural gas.

24. A method of connecting an articulated conduit system for transferring a fuel gas between a tug and barge of an articulated tug and barge (ATB) arrangement, wherein the tug is positioned within a notch at the stern of the barge, and wherein the tug is configured to push the barge through a pin connection, and wherein, when connected, the articulated conduit system comprises a plurality of rigid conduits fluidically interconnected by swivel joints that accommodate different movement between the tug and barge, wherein the swivel joints comprise i) at least three swivel joints each having an axis of rotation substantially parallel to a forward-aft axis of the tug such that each of the at least three swivel joints is rotatable about its axis of rotation in a substantially port-starboard plane, wherein together the at least three swivel joints are rotatable in their substantially port-starboard planes to accommodate relative vertical displacement between the tug and barge and relative rotation of the tug and barge about the forward-aft axis of the tug, and ii) at least one swivel joint having an axis of rotation substantially parallel to a port-starboard axis of the tug such that the at least one swivel joint is rotatable about its axis of rotation in a substantially forward-aft plane to accommodate pitch motion between the tug and barge, the method comprising:

i) repositioning a tug portion of the articulated conduit system from a first stowed position on the tug to a first operational position, wherein in the first stowed position the tug portion has a proximal end and a distal end on the tug, and in the first operational position the tug portion has a proximal end on the tug and a distal end extending toward the barge;

ii) repositioning a barge portion of the articulated conduit system from a second stowed position on the barge to a second operational position, wherein in the second stowed position the barge portion has a proximal end and a distal end on the barge, and in the second operational position the barge portion has a proximal end on the barge and a distal end extending toward the tug; and iii) fluidically connecting the distal end of the tug portion when in the first operational position to the distal end of the barge portion when in the second operational position.

25. The method of claim 24, wherein a plurality of the rigid conduits are fluidically connected by at least one swivel joint configured to permit the tug portion to be repositioned by being rotated from the first stowed position to the first operational position, and at least one swivel joint configured to permit the barge portion to be repositioned by being rotated from the second stowed position to the second operational position.

26. The method of claim 25, wherein the at least one swivel joint configured to permit rotation of the tug portion has an axis of rotation substantially parallel to a vertical axis of the tug such that the at least one swivel joint is rotatable about its axis of rotation in a yaw plane of the tug to permit the tug portion to be rotated between the first stowed position and the first operational position.

27. The method of claim 25, wherein the at least one swivel joint configured to permit rotation of the barge portion has an axis of rotation substantially parallel to a vertical axis of the barge such that the at least one swivel joint is rotatable about its axis of rotation in a yaw plane of the barge to permit the barge portion to be rotated between the second stowed position and the second operational position.

28. The method of claim 24, wherein the articulated conduit system is configured such that, at each relative vertical position of a pin connection of the tug within a vertical channel in a notch of the barge, up to and including 15 vertical feet from the bottom of the barge, the distal end of the tug portion is connectable in step iii) to the distal end of the barge portion.

29. The method of claim 28, wherein the pin connection is a single degree of freedom pin connection within the barge notch, that establishes a transverse, fixed axis between the tug and barge, about which the tug and barge are allowed pitch rotation.

30. The method of claim 24, wherein the articulated conduit system is configured such that, at each rotational position of the tug about its forward-aft axis, up to and including ±20° of rotation relative to the barge, the distal end of the tug portion is connectable in step iii) to the distal end of the barge portion.

* * * * *